US007477094B2

(12) United States Patent
Date et al.

(10) Patent No.: US 7,477,094 B2
(45) **Date of Patent: *Jan. 13, 2009**

(54) CURRENT DRIVING DEVICE AND DISPLAY DEVICE

(75) Inventors: Yoshito Date, Shiga (JP); Tetsurou Oomori, Osaka (JP); Makoto Mizuki, Kyoto (JP); Shiro Dosho, Osaka (JP)

(73) Assignee: Panasonic Corporation, Osaka (JP)

( * ) Notice: Subject to any disclaimer, the term of this patent is extended or adjusted under 35 U.S.C. 154(b) by 405 days.

This patent is subject to a terminal disclaimer.

(21) Appl. No.: 10/797,245

(22) Filed: Mar. 11, 2004

(65) Prior Publication Data

US 2004/0227499 A1 Nov. 18, 2004

(30) Foreign Application Priority Data

May 12, 2003 (JP) ..... 2003-133342

(51) Int. Cl.
*G05F 1/10* (2006.01)

(52) U.S. Cl. ..... 327/538; 327/538

(58) Field of Classification Search ..... 323/315; 327/53, 66, 105, 538, 539, 540, 541, 542, 327/543; 345/169.3, 169.4, 76
See application file for complete search history.

(56) References Cited

U.S. PATENT DOCUMENTS 6,332,661 B1 12/2001 Yamaguchi
6,456,270 B1 9/2002 Itakura
6,509,854 B1 1/2003 Morita et al.
6,586,888 B2 7/2003 Kitahara et al.
6,765,560 B1 7/2004 Ozawa
6,777,885 B2 * 8/2004 Koyama ..... 315/169.1
6,882,186 B2 4/2005 Nishitoba
6,897,619 B2 5/2005 Shimizu
6,924,601 B2 * 8/2005 Date ..... 315/169.1
6,958,742 B2 10/2005 Date et al.
2003/0117421 A1 * 6/2003 Cheng ..... 345/690
2003/0122808 A1 7/2003 Sase
2003/0151567 A1 8/2003 Hanada et al.
2003/0184568 A1 10/2003 Date et al.
2005/0024100 A1 * 2/2005 Date et al. ..... 327/105
2005/0200583 A1 * 9/2005 Date ..... 345/89

FOREIGN PATENT DOCUMENTS

JP 62-262517 11/1987

(Continued)

*Primary Examiner*—Akm E Ullah
*Assistant Examiner*—Richard V Muralidar
(74) *Attorney, Agent, or Firm*—McDermott Will & Emery LLP

(57) ABSTRACT

A current driving device includes a reference current source, a first MISFET connected to the reference current source, a plurality of current distribution MISFETs which constitutes a current mirror together with the first MISFET and distributes a reference current, a current input MISFET connected to the current distribution MISFETs, and a plurality of current supply sections each of which includes MISFETs constituting a current mirror circuit together with the current input MISFET and supplies a driving current for a pixel circuit. With the plurality of current distribution MISFETs provided, change in gate the potential of MISFETs in the current supply section can be suppressed, so that the generation of a crosstalk in a display device can be suppressed.

12 Claims, 23 Drawing Sheets

FOREIGN PATENT DOCUMENTS

| | | |
|---|---|---|
| JP | 01-212026 | 8/1989 |
| JP | 03-118166 | 5/1991 |
| JP | 03-125205 | 5/1991 |
| JP | 5-216439 | 8/1993 |
| JP | 06-169139 | 7/1996 |
| JP | 09-319323 | 12/1997 |
| JP | 11-205147 | 7/1999 |
| JP | 11-340765 | 12/1999 |
| JP | 2000-122606 | 4/2000 |
| JP | 2000-293245 | 10/2000 |
| JP | 2000-310981 | 11/2000 |
| JP | 2001-042627 | 2/2001 |
| JP | 2002-055854 | 2/2002 |
| JP | 2002-202823 | 7/2002 |
| JP | 2003-066902 | 3/2003 |
| JP | 2003-066903 | 3/2003 |
| JP | 2003-066904 | 3/2003 |
| JP | 2003-066906 | 3/2003 |
| JP | 2003-092165 | 3/2003 |
| JP | 2003-0191261 | 3/2003 |
| JP | 2003-131620 | 5/2003 |
| JP | 2003-283267 | 10/2003 |
| JP | 2003-288045 | 10/2003 |
| JP | 2004-271646 | 9/2004 |
| JP | 2004-271759 | 9/2004 |
| JP | 2004-294762 | 10/2004 |
| WO | WO 03/027998 | 4/2003 |

* cited by examiner

XXIb
XXIb

IV curve of TFT
Output IV characteristics
I
V
Vblack≒4V
1005a1
1104
1102
TFT
TFT
EL
1103
1220a1
1001a1
1115-1
1115-2
1115-m
1112-1
1112-2
1112-m
1101
1108
1109
1107
1110
PRIOR ART IV curve of TFT
Output IV characteristics
I
V
Vwhite≒2V
1005an
TFT
TFT
EL
1220an
1001an Luminescent line
XXIIb
XXIIb IV curve of TFT
Output IV characteristics
I
V
Vblack≒4V
1005a1
1102
1104
1103
TFT
TFT
EL
1220a1
1001a1
1115-1
1115-2
1115-m
1112-1
1112-2
1112-m
Cgd
1051
1050

IV curve of TFT
Output IV characteristics
I
V
Vwhite≒2V
1005an
TFT
TFT
EL
1220an
1001an
1101
1108
1109
1107
1110

CURRENT DRIVING DEVICE AND DISPLAY DEVICE

CROSS-REFERENCE TO RELATED APPLICATION

This nonprovisional application claims priority under 35 U.S.C. §119(a) on Japanese Patent Application No. 2003-133342, the entire contents of which are hereby incorporated by reference. Further, it is noted that pending U.S. patent application Ser. Nos. 10/815,800 and 11/124,265 contained subject matter related to the instant application.

BACKGROUND OF THE INVENTION

The present invention relates to current driving devices, and more particularly relates to a technique used for a preferable current driving device as a display driver such as an organic EL (electro luminescence) panel.

In recent years, the size and definition of flat panel displays such as organic EL panels have been increased. At the same time, flat panel displays have been made thinner and lighter and also costs for fabricating such panels have been reduced. In general, an active matrix method is preferably used as a driving method for a large-size, high definition display panel. Hereinafter, a known display driver for an active matrix display panel will be described.

FIG. 20 is a circuit diagram illustrating the configurations of a display panel and a known current driving device serving as a display driver connected to the display panel. Herein, a display panel means to be an organic EL panel.

As shown in FIG. 20, the known current driving device includes current supply sections 1001*a*1, 1001*a*2, . . . and 1001*an* (hereinafter, referred to as a "current supply section 1001*a* when the current supply sections are not distinguished from each other) for supplying driving currents to a plurality of pixel circuits 1005*a*1, 1005*a*2, . . . and 1005*an* (hereinafter, referred to as a "pixel circuit 1005*a* when the pixel circuits are not distinguished from each other) formed on a display panel, respectively, and a reference current supply section (bias circuit) 1101 for supplying a reference current to each section in the current supply section 1001*a*. Note that a "reference current" herein means to be not only a predetermined current flowing from a reference current generator but also a current from a reference current generator transmitted by a current mirror circuit.

When the size of a display panel is large as in a television display device, a large number of current supply sections 1001*a* are provided so that the current supply sections 1001*a* are divided onto a plurality of semiconductor chips 1105. The semiconductor chips 1105 are arranged in a frame portion of a display panel in many cases.

Each of the pixel circuits 1005*a*1, 1005*a*2, . . . and 1005*an* includes a p-channel first TFT (thin-film-transistor) 1104 connected to the current supply section 1001*a* via a signal line, a second TFT 1102 constituting a current mirror circuit together with the first TFT 1104, and an organic EL device 1103 for emitting light in accordance with a current supplied from the second TFT 1102.

The reference current supply section 1101 includes a p-channel first MISFET 1108 to which a supply voltage is supplied at a terminal, a resistor 1107 which is connected with the first MISFET 1108 and generates a reference current, a p-channel second MISFET 1109 constituting a current mirror circuit together with the first MISFET 1108, and an n-channel current input MISFET 1110 for transmitting a reference current to the current supply portion 1001*a*.

When a gray scale of m bits is controlled, each of the current supply section 1001*a* includes current sources 1112-1, 1112-2, . . . and 1112-*m* (m is a positive integer) arranged in parallel to an output section connected to the pixel circuit 1005*a* and switches 1115-1, 1115-2, and 1115-*m* for controlling currents flowing in the current sources 1112-1, 1112-2, . . . and 1112-*m*, respectively, to turn the current ON or OFF. Herein, each of the current sources 1112-1, 1112-2, . . . and 1112-*m* is formed of an n-channel MISFET 1110 constituting a current mirror circuit together with the current input MISFET 1110. Moreover, each of the switches 1115-1, 1115-2, . . . and 1115-*m* independently performs a switching operation based on display data.

FIG. 23 is a circuit diagram illustrating the arrangement and configuration of a current supply section in the known current driving device. In FIG. 23, an example of current supply sections for 64 gray scale in which six current sources are provided in each current supply section is shown. The current sources 1112-1, 1112-2, . . . and 1112-*m* include an MISFET, two MISFETs, . . . and 32 MISFETs having the same size and properties, respectively. These MISFETs are arranged in the manner shown in the upper part of FIG. 23 when viewed from the top. Connections are made so that adjacent ones of the MISFETs are connected to a single output section.

With the above-described configuration, the current supply section 1001*a* is substantially operated as a current mode D/A converter, receives display data as a digital signal, and withdraws as an analog signal a current having an amount corresponding to the display data from an output section.

As has been known, an organic EL device has the rectifying action as a diode does and the illuminance of the organic EL device varies in accordance with the amount of a current conducted. In the pixel circuit 1005*a*, the amount of a current conducted by the organic EL device 1103 varies in accordance with the amount of a current flowing in the TFT 1104. Accordingly, the organic EL device 1103 is current-driven by the current supply section 1001*a*, so that the illuminance of the organic EL device 1103 varies.

As has been described, the current driving device current-drives the plurality of pixel circuits 1005*a* in the display panel based on display data to achieve a gray scale display (see, e.g., Japanese Unexamined Patent Publication No. 11-88072 and Japanese Unexamined Patent Publication No. 11-340765).

SUMMARY OF THE INVENTION

However, in a display device having the above-described configuration, display distortion such as nonuniformity sometimes occurs while an image is displayed. There seem to be several possible reasons for this.

First, display distortion due to charge injection from the display panel and momentary-change of a bias voltage, i.e., the generation of so-called "crosstalk" is considered to be a possible reason. Hereinafter, description on this "crosstalk" will be given.

FIG. 21A is a view illustrating an example of black and white displays in a display panel. FIG. 21B is a circuit diagram illustrating the pixel circuits arranged along the line XXIb—XXIb of the display panel shown in FIG. 21A and known current supply sections connected to the pixel circuits. FIG. 21C is a graph showing an operating point of a TFT in a black display state. And FIG. 21D is a graph showing an operating point of the TFT in a white display state. Moreover, FIG. 22A is a view illustrating an example of black and white displays in a display panel, as FIG. 21A. FIG. 22B is a circuit diagram illustrating the pixel circuits arranged along the line XXIIb—XXIIb of the display panel shown in FIG. 22A and known current supply sections connected to the pixel circuits. FIG. 22C is a graph showing an operating point of a TFT when a black display is changed to a white display. And FIG. 22D is a graph showing an operating point of the TFT when a white display is continuously performed.

As shown in FIG. 21B, when the known display device performs a black display, all of the switches 1115-1, 1115-2, . . . and **1115-*m* in the current supply section 1001*a* are in an OFF state. When the known display device performs a white display, all of the switches 1115-1, 1115-2, . . . and 1115-*m* in the current supply section 1001*a*** are in ON state.

At this time, a stray capacitance **1220*a*1 generated in the pixel circuit 1005*a*1 for performing a black display and a signal line connected to the pixel circuit 1005*a*1 and the like are charged by a power supply, so that each of gate voltages of the first and second TFTs 1104 and 1102 is increased to, for example, about 4 V. As shown in FIG. 21C, an operating point of the first and second TFTs 1104 and 1102 at this time is an intersection of the IV characteristic curve of the current supply section 1001*a*** and the IV characteristic curve of a TFT.

On the other hand, when a white display is performed, charge is drawn to the current supply section **1001*an* side, so that charge stored in a stray capacitance 1220*an* generated in the pixel circuit 1005*an* and a signal line connected to the pixel circuit 1005*an* is less than that when a black display is performed. Accordingly, each of gate voltages of the first and second TFTs 1104 and 1102 becomes, for example, about 2 V and an operating point of the first and second TFTs 1104 and 1102 is lower than in the case of a black display. These operating points are varied due to an ON resistance of a TFT and the amount of current withdrawn by the current supply section 1001*a***.

Moreover, in FIG. 22B, the pixel circuit and the current supply section when a black display is changed to a white display, and the pixel circuit and the current supply section when a white display is continuously performed are shown. When a black display is changed to a white display, all of the switches 1115-1, 1115-2, . . . and 1115-6 of the current supply section **1001*a*1 are turned ON and then a current at a maximum amount flows from the panel side. Thus, the organic EL device 1103 in the pixel circuit 1005*a*1** emits light at a maximum illuminance.

At this time, the charge stored in the stray capacitance **1220*a*1 is injected to the current supply section 1001*a*1** via the signal line.

When the amount of charge injected is relatively small, the charge passes through the current sources 1112-1, 1112-2, . . . and 1112-6 to reach the ground. However, since the pixel circuit **1005*a*1 performed a black display until immediately before a white display is initiated, the stray capacitance 1220*a*1 is charged to a level close to the power supply voltage. Accordingly, at the moment when the current supply section 1001*a*1 and the pixel circuit 1005*a*1 are electrically connected to each other, a voltage close to the power supply voltage is applied to the drain of each of the current sources 1112-1, 1112-2, . . . and 1112-6, so that the potential of a bias line 1050 is temporarily increased via a parasitic capacitance Cgd which exits between a gate and a drain. The waveform 1051 shown in FIG. 22B shows change in a voltage generated in the bias line 1050**.

A gate electrode of a current source in another current supply section **1001*a* is connected to a bias line 1050. Thus, when voltage change as indicated by the waveform 1051 occurs in the bias line 1050, the amount of a current flowing in the current supply section 1001*a* is temporarily increased. As a result, the current supply section 1001*an* is temporarily in an excessive driving state, as shown by a dotted line in FIG. 22**D.

If change in the voltage of the bias line 1050 converges during a display data writing period, the current supply section **1001*a* is back to a predetermined driving state, so that a normal display is performed. However, if change in the voltage of the bias line 1050 does not converge during a display data writing period, the pixel circuit 1005*a*** is continuously in the excessive driving state also in a subsequent frame. Thus, a crosstalk display in which a luminescent line is visually recognized is generated.

However, by contrast to the above-described case, a temporary drop of a voltage occurs in the bias line 1050 when a white display is changed to a black display. Thus, a crosstalk in which a dark line with reduced luminance is visually recognized is generated.

By the way, the stray capacitance **1220*a* is several pF to several tens pF in a small panel used for cellular phones. There are also large panels in which the stray capacitance 1220*a*** is 100 pF or more. As the size of a display panel becomes larger, such a crosstalk display appears more clearly. Specifically, the current driving device for an organic EL panel drives a pixel circuit by a very small current of about several tens A. Thus, a crosstalk display is easily generated.

Note that there may be cases in which some other factor causes distortion of an image display than the above-described crosstalk.

Moreover, in recent years, display panel screens become larger and larger. With the increase in the display panel size, there are cases in which the length of a display device driver LSI (i.e., the length in the direction in which a longer side thereof extends) is 10–20 mm. In this case, if a semiconductor chip including the known current driving device is used, output voltages vary between output terminals separately located from each other. This might cause reduction in image quality such as the generation of a shading portion in a display image.

The present inventors examined factors causing variations in output voltage between the output terminals of the display device driver LSI (semiconductor chip) and then found that currents distributed to MISFETs constituting the current source 1112 (see FIG. 20) located on the semiconductor chip varied. In the first place, the current mirror circuit is provided on the assumption that diffusion conditions for transistors constituting the current mirror circuit are the same and thus there is no significant difference in threshold voltage Vt and carrier mobility. Then, according to the ratio between the transistor sizes, currents are distributed. However, if the length of a chip of the display device driver LSI is 10–20 mm, it seems difficult to uniformly diffuse an impurity contained in each of the transistors. In addition, if the transistors are located in a different manner, variation in display may be generated due to variations in fabrication process steps such as etching. As a result, the threshold of a transistor to serve as a current mirror varies. If the threshold varies, application of the same gate voltage causes an error for an output current. Normally, the diffusion change shows gradual increase or decrease in a wafer surface. Thus, even when a uniform display based on a constant display data is performed, a gradation from bright to dark is generated on the display panel.

Moreover, in the display device including a large screen display panel, a plurality of semiconductor chips in which a current driving device including a current supply section is provided are used. In this case, values for currents output from the respective current driving devices located on different semiconductor chips vary. In the display device, fabrication conditions such as diffusion conditions for the semiconductor chips arranged adjacent to each other are different in many cases. Accordingly, properties of MISFETs constituting a current source of the current supply section 1001*a*1 widely vary. Therefore, display nonuniformity is visibly recognized in each of the semiconductor chips in more cases.

Thus, variation in each output section of the current supply section 1001*a* and also variation in properties of each of the semiconductor chips cause distortion in a display image as in the same manner as a crollstalk.

It is therefore an object of the present invention to solve any one of the various problems described above, thereby providing a current driving device which allows suppression of distortion in an image display.

A first current driving device according to the present invention is a current driving device provided on a semiconductor chip, including: a first-conductive-type first MISFET to which from a reference current source for making a reference current flow, the reference current is transmitted; a first-conductive-type current distribution MISFET which constitutes a current mirror circuit together with the first MISFET and makes the reference current flow; a second-conductive-type current input MISFET connected to the current distribution MISFET; a plurality of current supply sections each including second-conductive-type current source MISFETs constituting a current mirror circuit together with the current input MISFET and an output terminal for outputting a current in accordance with display data; a second-conductive-type current transmission MISFET constituting a current mirror circuit together with the current source MISFETs and the current input MISFET; and a reference current output terminal which is provided on a region of the semiconductor chip located at a distance of 200 μm or less from the current transmission MISFET and outputs a current transmitted from the current transmission MISFET.

Thus, when a plurality of semiconductor chips each including the current driving device of the present invention are arranged and a large screen display panel is driven, a current with a small error can be transmitted to a semiconductor chip in a subsequent stage. Therefore, variation in output currents in each semiconductor chip can be reduced, compared to a known current driving circuit. As a result, a large screen or high definition display device in which display nonuniformity and display distortion are suppressed can be achieved.

It is more preferable that the reference current output terminal is provided on a region of the semiconductor chip located at a distance of 100 μm or less from the current transmission MISFET, because an error of a current transmitted to a semiconductor chip in a subsequent stage can be further reduced.

If the reference current source is located outside of the semiconductor chip, and a first reference current input terminal which is connected to the reference current source and transmits a current to the current input MISFET is further provided on a region of the semiconductor chip located at a distance of 200 μm or less, a reference current output from a semiconductor chip in a previous stage can be transmitted to a current input MISFET with a small error in the case where semiconductor chips are cascaded. Therefore, when the first current driving device is used for a display device, display nonuniformity in each semiconductor chip can be reduced.

If the current driving device further includes: a first reference current input terminal connected to a drain of the first MISFET and provided on a region of the semiconductor chip located at a distance of 200 μm or less from the current input MISFET; an input side current mirror circuit connected to the drain of the first MISFET and including a second-conductive-type MISFET; a second reference current input terminal connected to the input side current mirror circuit and provided on a region of the semiconductor chip located at a distance of 200 μm or less from the current input MISFET; and an output side current mirror circuit provided on a current transmission path from the current transmission MISFET to the reference current output terminal and including a first-conductive-type MISFET, pixel circuits on a display panel can be driven with semiconductor chips of a single type arranged. Therefore, fabrication costs for a display device can be reduced, compared to the case where semiconductor chips of different types are used.

When a plurality of units of the current distribution MISFET and the current input MISFET are provided for the semiconductor chip, the number of gate electrodes of current source MISFETs connected to a current input MISFET can be reduced, compared to the known device. Accordingly, change in the gate potential of current source MISFETs can rapidly converge. Therefore, with the current driving device of the present invention, display nonuniformity in each semiconductor chip can be suppressed while the generation of a crosstalk can be suppressed.

When the current driving device of the present invention further includes between each of the current distribution MISFETs and each of the current input MISFETs, connection changing means for changing a connection so that each of the current distribution MISFETs is connected to a different one of current input MISFETs in every predetermined period, property variation of the current distribution MISFET can be averaged. Therefore, a display device in which display nonuniformity is further suppressed can be achieved.

If on the semiconductor chip, a plurality of MISFET regions each collectively including the current source MISFETs are arranged in a row, and each of the plurality of current supply sections includes MISFETs arranged in at least two of the plurality of MISFET regions, property variation of the current source MISFETs can be averaged. Therefore, a display device of which display nonuniformity is hardly recognized visually and which has high display quality can be achieved.

If respective gate electrodes of the current distribution MISFETs are connected to a bias line so as to share the bias line with one another, and a resistance element is further provided on the bias line and between respective gate electrodes of adjacent ones of the current distribution MISFETs, a gate voltage applied to the current distribution MISFET can be changed in accordance with variation in the threshold of the current distribution MISFET. As a result, variation in a reference current distributed to each of the current supply sections can be reduced.

A second current driving device according to the present invention includes: a first-conductive-type first MISFET in which a reference current flows in a driving state; a first-conductive-type first current distribution MISFET which constitutes a current mirror circuit together with the first MISFET and makes the reference current flow; a second-conductive-type first current input MISFET having a drain connected to the first current distribution MISFET; and a plurality of current supply sections each including second-conductive-type current source MISFETs constituting a current mirror circuit together with the first current input MISFET, switches which are connected to the current source MISFETs and turn ON or OFF a current flowing in the current source MISFETs in accordance with display data, and an output terminal which is connected to the switches and outputs a current in accordance with the display data to a display panel, the current driving device being provided on a semiconductor chip. In the current driving device, a plurality of units of the first current distribution MISFET and the first current input MISFET are provided for the semiconductor chip, and a bias line connected to a gate electrode of the first MISFET and gate electrodes of the first current distribution MISFETs and shared by the gate electrodes is further provided.

Thus, the number of gate electrodes of the current source MISFETs connected to the first current input MISFET can be reduced, compared to the known device, so that change in a gate potential of the current source MISFETs can be rapidly converges. Accordingly, with the current driving device of the present invention, the generation of a crosstalk display can be suppressed. Therefore, a display device including a large screen or high definition display panel can be achieved.

If all of respective gate electrodes of the current source MISFETs in the plurality of current supply sections and a gate electrode of the first current input MISFET are connected to one another, a gate potential applied to the current source MISFETs can be changed in accordance with variation of the threshold. Therefore, variation in output currents in each output terminal can be suppressed.

If each of the plurality of current supply sections includes a second-conductive-type first cascode MISFET which is provided between each of the switches and the output terminal and is turned ON when a voltage equal to or lower than a power supply voltage of the display panel is applied to a gate electrode in a driving state, application of a high voltage from the display panel to the current source MISFETs can be prevented in changing a display in the case where the current driving device of the present invention is used and the first cascode MISFET is the n-channel type. Therefore, the generation of a crosstalk display can be suppressed.

Also, if each of the switches is a second cascode MISFET which forms a cascode connection together with the current source MISFETs and is controlled to be turned ON or OFF depending on whether or not a predetermined voltage is applied to a gate electrode in a driving state, the second cascode MISFET can limit a high voltage applied from the display panel in the case where output terminals are connected to the display panel More specifically, if each of the switches is made to serve as a current limiting MISFET, a circuit area can be reduced, compared to the case where a voltage limiting MISFET is separately provided.

If the second current driving device further includes between each of the first current distribution MISFETs and each of the first current input MISFETs, connection changing means for changing a connection so that each of the first current distribution MISFETs is connected to a different one of the current input MISFETs in every arbitrary period, reference currents distributed by the current distribution MISFET are shuffled and output. Therefore, property variation of the current distribution MISFET can be averaged.

More specifically, it is preferable that the connection changing means includes a first bias current switch and a second bias current switch.

If on the semiconductor chip, further provided are a first terminal temporarily connected to the first bias current changing switch in a driving state and a second terminal temporarily connected to the second bias current changing switch in a driving state, change can be made so that currents distributed by the current distribution MISFETs are output from the output terminal of an adjacent semiconductor chip via the first terminal and second terminal. Thus, variation in output currents in a semiconductor chip but also variation in output currents in adjacent semiconductor chips can be averaged.

Moreover, if the second current driving device of the present invention further includes: a first-conductive-type dummy current distribution MISFET constituting a current mirror circuit together with the first MISFET and the first current distribution MISFET; and a dummy connection changing means for temporarily connecting the dummy current distribution MISFET and the current input MISFET, control can be performed so that current distribution MISFETs to be connected, for example, between adjacent current input MISFETs are sequentially changed. Therefore, output currents from output terminals can be made uniform in a relatively simple manner.

If on the semiconductor chip, a plurality of MISFET regions each collectively including the current source MISFETs are arranged in a row, and each of the plurality of current supply sections includes MISFETs arranged in at least two of the MISFET regions, property variations of the current distribution MISFETs and the current source MISFETs can be averaged, so that an error of an output current between output terminals can be reduced. More specifically, there is no need for providing another element and an interconnect structure can be arbitrarily change. Therefore, increase in a circuit area can be suppressed.

If the second current driving device further includes a resistance element provided on the bias line and between respective gate electrodes of adjacent ones of the current distribution MISFETs, a gate voltage applied to the current distribution MISFETs can be changed in accordance with variation of the threshold of the current distribution MISFETs.

A third current driving device according to the present invention includes: a first-conductive-type first current input MISFET in which a first reference current flows in a driving state; a first-conductive-type second current input MISFET in which a second reference current flows in a driving state; and a plurality of current supply sections each including first-conductive-type current source MISFETs constituting a current mirror circuit together with the first current input MISFET, switches which are connected to the current source MISFETs and turn ON or OFF a current flowing in the current source MISFETs in accordance with display data, a first-conductive-type cascode MISFET which is provided between the current source MISFETs and one of the switches and constitutes a current mirror circuit together with the second current input MISFET, and an output terminal which is connected to the switches and outputs a current in accordance with the display data; the current driving device being provided on a semiconductor chip.

Thus, an output current from an output terminal is an averaged value of a current to flow in the current source MISFETs and a current to flow in the cascode MISFET. Therefore, property variation of the current source MISFETs and property variation of the cascode MISFET can be cancelled off each other. As a result, variation in output currents from output terminals can be reduced.

A fourth current driving device of the present invention includes: a first reference current input terminal for receiving a first reference current; a first-conductive-type first current input MISFET to which a current flowing in the first reference current input terminal is transmitted in a first period; a plurality of current supply sections each including first-conductive-type current source MISFETs constituting a current mirror circuit together with the first current input MISFET in the first period and an output terminal for outputting a current in accordance with display data; a first-conductive-type first current transmission MISFET constituting a current mirror circuit together with the first current input MISFET and the current source MISFETs in the first period; a first reference current output terminal to which a current flowing in the first current transmission MISFET is transmitted in the first period; a second reference current input terminal for receiving a second reference current; a first-conductive-type second current input MISFET to which a current flowing in the second reference current input terminal is transmitted in a second period and which constitutes a current mirror circuit together with the current source MISFETs; a first-conductive-type second current transmission MISFET constituting a current mirror circuit together with the current source MISFETs in the second period; a second reference current output terminal to which a current flowing in the second current transmission MISFET is transmitted in the second period; a first switch provided on a current transmission path between the first reference current input terminal and the first current input MISFET; a second switch provided on a current transmission path between the first current transmission MISFET and the first reference current output terminal; a third switch provided on a current transmission path between the second reference current input terminal and the second current input MISFET; and a fourth switch provided on a current transmission path between the second current transmission MISFET and the second reference current output terminal.

Thus, the first and second switches are turned ON in the first period and the third and fourth switches are turned OFF in the second period, so that a driving state of driving with a first reference current and a driving state of driving with a second reference current can be changed around. As a result, variation in output currents from the current supply section can be suppressed, thereby allowing a uniform display.

A first display device according to the present invention includes: a display panel in which a pixel circuit including a light emitting element having a luminance variable in accordance with the amount of a supplied current is provided; and a current driving device which is provided on each of a plurality of semiconductor chips arranged in a row and supplies a driving current to the pixel circuit. In the first display device, each of the plurality; of the semiconductor chips includes a reference current input terminal for receiving a reference current in an end portion and a reference current output terminal for outputting a reference current for a semiconductor chip in a subsequent stage in another end portion, and the reference current input terminal and the reference current output terminal located in adjacent ones of the plurality of the semiconductor chips, respectively, are provided so as to face each other.

Thus, a transmission path through which a reference current flows can be made the shortest between semiconductor chips each including a current driving device. Therefore, variation in output currents in each semiconductor chip can be reduced, compared to the known device.

A second display device according to the present invention includes: a display panel in which a pixel circuit including a light emitting element having a luminance variable in accordance with the amount of a supplied current is provided; and a plurality of semiconductor chips each including a current driving device for supplying a driving current to the pixel circuit. In the second display device, the current driving device includes a first-conductive-type first MISFET in which a reference current flows in a driving state, a plurality of first-conductive-type current distribution MISFETs which constitutes a current mirror circuit together with the first MISFET and makes the reference current flow, a plurality of second-conductive-type current input MISFETs each having a drain connected to each of the plurality of the current distribution MISFETs, and a plurality of current supply sections each including second-conductive-type current source MISFETs constituting a current mirror circuit together with the current input MISFET and an output terminal for outputting to the pixel circuit a driving current in accordance with the display data.

Thus, change in the gate potential of the current source MISFETs can rapidly converge, so that the generation of a crosstalk display can be suppressed. Therefore, a uniform display can be achieved.

A third display device according to the present invention includes: a display panel in which a pixel circuit including a light emitting element having a luminance variable in accordance with the amount of a supplied current is provided; and a plurality of semiconductor chips each including a current driving device for supplying a driving current to the pixel circuit. In the third display device, the current driving device includes a first-conductive-type first current input MISFET in which a first reference current flows in a driving state, a first-conductive-type second current input MISFET in which a second reference current flows in a driving state, and a plurality of current supply sections each including first-conductive-type current source MISFETs constituting a current mirror circuit together with the first current input MISFET, switches which are connected to the current source MISFETs and turn ON or OFF a current flowing in the current source MISFETs in accordance with display data, a first-conductive-type cascode MISFET which is provided between the current source MISFETs and the switches and constitutes a current mirror circuit together with the second current input MISFET, and an output terminal which is connected to the switches and outputs to the pixel circuit a driving current in accordance with the display data.

Thus, an output current from an output terminal is an averaged value of a current to flow in the current source MISFETs and a current to flow in the cascode MISFET. Therefore, property variation of the current source MISFETs and property variation of the cascode MISFET can be cancelled off each other. As a result, variation in output currents from output terminals can be reduced.

If on each of the plurality of semiconductor chips, further provided are a first reference current input terminal for receiving the first reference current, a first reference current output terminal for outputting the first reference current, a second reference current input terminal for receiving the second reference current, and a second reference current output terminal for outputting the second reference current, and the first reference current output terminal is connected to the first reference current input terminal of an adjacent semiconductor chip, and the second reference current output terminal is connected to the second reference current input terminal of the adjacent semiconductor chip, variation in output currents from terminals in a single semiconductor chip can be reduced, and at the same time, variation in output currents between semiconductor chips can be reduced. Therefore, a uniform display can be performed throughout a display panel.

DESCRIPTION OF THE PREFERRED EMBODIMENTS

First Embodiment

Figure 1:
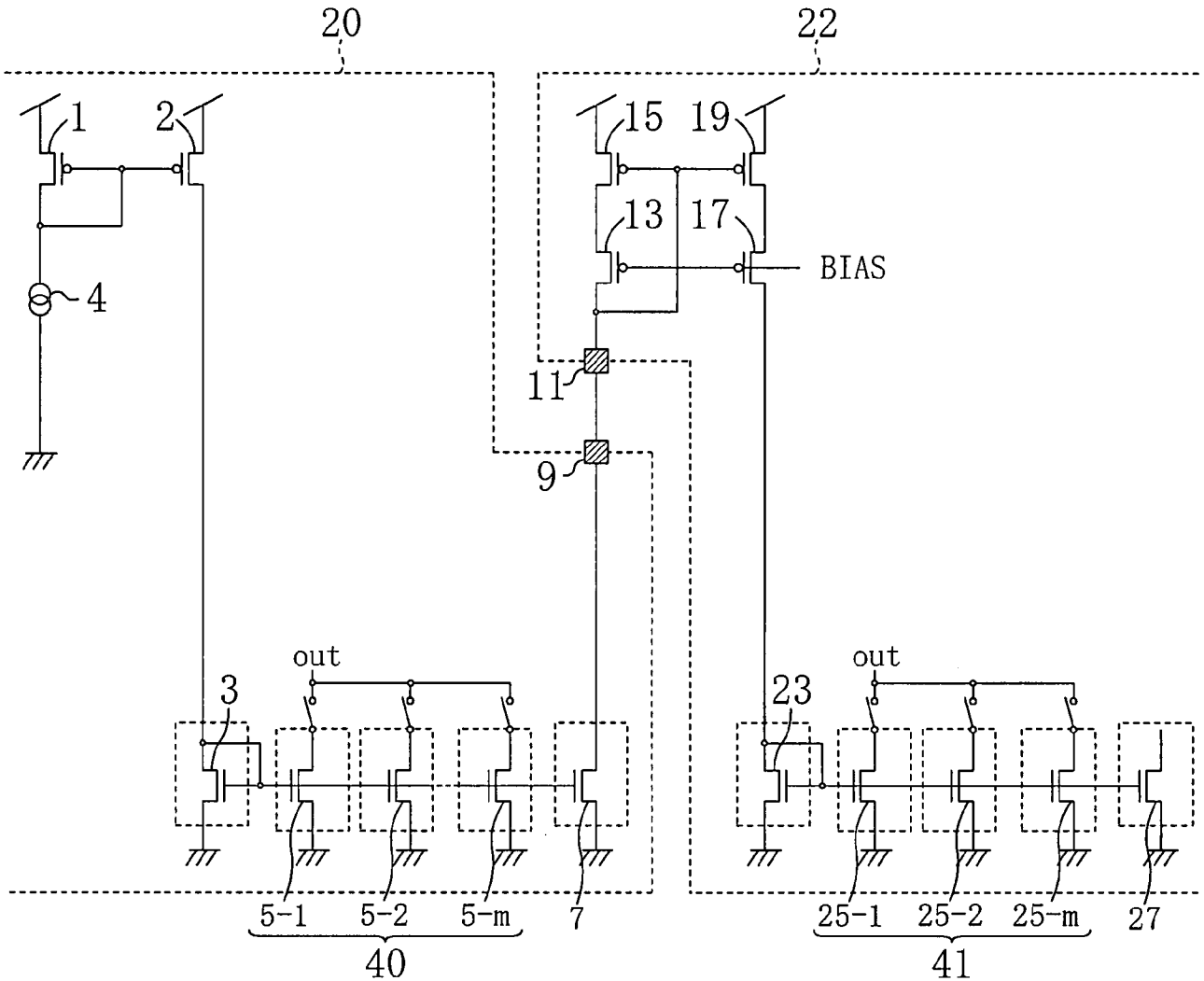
FIG. 1 is a circuit diagram illustrating a connection portion of two chips each including a current driving device according to a first embodiment of the present invention.

FIG. 1 is a circuit diagram illustrating a connection portion of two chips each including a current driving device according to a first embodiment of the present invention.

A display device according to this embodiment includes a display panel in which pixel circuits (not shown) each including an organic EL device is provided and a current driving device for supplying a driving current to the pixel circuit via a signal line. The current driving device is used as a source driver of a current driving type display device such as an organic EL display device, as in the current driving device shown in FIG. 20. In the display device of this embodiment, a plurality of semiconductor chips each including an integrated current driving device is provided are arranged in a frame portion of a display panel. In FIG. 1, two semiconductor chips located adjacent to each other are shown as first and second semiconductor chips 20 and 22.

In the display device of this embodiment, the first semiconductor chip 20 includes a current supply section 40 for supplying a driving current to each of the plurality of circuits (not shown) provided in a display panel, a reference current supply section for supplying a reference current to the current supply section 40, an n-channel first current transmission MISFET 7, and a reference current output terminal 9 connected to the first current transmission MISFET 7. The reference current output terminal 9 is provided in part of the first semiconductor chip 20 facing the second semiconductor chip 22. Although the current supply section 40 is actually provided in a plural number (e.g., 528), only one current supply section 40 is shown in FIG. 1.

The reference current supply section includes a p-channel first MISFET 1 in which a power supply voltage is supplied at one end, a reference current source 4 which is connected to the first MISFET 1 and generates a reference current, a p-channel second MISFET (current distribution MISFET) 2 constituting a current mirror circuit together with the first MISFET 1, and an n-channel current input MISFET 3 which is connected to the second MISFET 2 and transmits a reference current to the current supply section 40.

Moreover, the current supply section 40 includes current sources 5-1, 5-2, . . . and **5-*m* (m is a positive integer) and switches for turning a current flowing each of the current sources ON or OFF. Each of the current sources 5-1, 5-2, . . . and 5-*m* is formed of an MISFET (current source MISFET) constituting a current mirror circuit together with the current input MISFET 3 and the first current transmission MISFET 7. For example, the current source 5-1 is formed of an MISFET, the current source 5-2 is formed of two MISFETs connected in parallel to one another, and the current source 5-*m* is formed of $2^{m-1}$ MISFETs connected to in parallel one another. The current supply section 40** is a so-called current mode D/A converter in which each of the switches is turned ON or OFF in accordance with display data, thereby allowing $2^m$ gray scale display.

In the second semiconductor chip 22, provided are a reference current input terminal 11 connected to the reference current output terminal 9, a p-channel third MISFET 13 connected to the reference current input terminal 11, a p-channel fourth MISFET 15 which is cascoded to the third MISFET 13 and has a gate electrode connected to the reference current input terminal 11, a p-channel fifth MISFET 17 constituting a current mirror circuit together with the third MISFET 13, a p-channel sixth MISFET 19 which is cascoded to the fifth MISFET 17 and constitutes a current mirror circuit together with the fourth MISFET 15, an n-channel seventh. MISFET 23 (corresponding to the current input MISFET in the first semiconductor chip 20) for receiving a reference current flowing in the sixth MISFET 19, a current supply section 41 for supplying a driving current to each of the plurality pixel circuits (not shown) provided in the display panel, and an n-channel second current transmission MISFET 27 for transmitting a reference current to a semiconductor chip in a subsequent stage. Moreover, a reference current output terminal (not shown) connected to the second current transmission MISFET 27 is provided on the second semiconductor chip 22.

The reference current input terminal 11 is provided in the vicinity of part of the second semiconductor chip 22 facing the first semiconductor chip. More specifically, the reference current input terminal 11 is located so as to be close to the reference current output terminal 9.

Moreover, in the second semiconductor chip 22, the third MISFET 13, the fourth MISFET 15, the fifth MISFET 17, the sixth MISFET 19, and the seventh MISFET 23 function as a reference current supply section for transmitting a reference current from the first semiconductor chip 20 to the current supply section 41 via the reference current output terminal 9.

The current supply section 41 includes current sources 25-1, 25-2, . . . and **25-*m* (m is a positive integer) and switches for turning a current flowing each of the current sources ON or OFF. Each of the current sources 25-1, 25-2, . . . and 25-*m* is formed of one or more MISFETs constituting a current mirror circuit together with the seventh MISFET 23 and the second current transmission MISFET 27, as the current sources 5-1, 5-2, . . . and 5-*m***.

In FIG. 1, only two semiconductor chips are shown. However, some more chip(s) having the same configuration as that of the second semiconductor chip 22 may be further placed according to the size of the display panel. In many cases, semiconductor chips each including a current supply section are arranged in a row in a normal display device. In such a case, a reference current is transmitted from the reference current output terminal 9 provided in the vicinity of an end of each semiconductor chip to the reference current input terminal 11 in a cascade manner.

The semiconductor chips of this embodiment having the respective configurations described above are characterized in that the reference current supply section of the second semiconductor chip 22 is placed in the vicinity of the reference current input terminal 11 and the current transmission MISFET 7 of the first semiconductor chip 20 is placed in the vicinity of the reference current output terminal 9. In this case, each of the distance between the reference current supply section including the seventh MISFET 23 and the reference current input terminal 11 and the distance between the current transmission MISFET 7 and the reference current output terminal 9 may be a distance which does not cause variation in electric properties due to diffusion of an impurity and the like to be a problem. Although an appropriate distance differs according to fabrication conditions and process steps, a distance of 200 μm or less is permissible, and, more specifically, a distance of 100 μm or less is preferable in general.

Therefore, an output current of the current transmission MISFET 7 of adjacent semiconductor chips can be distributed as a reference current for the second semiconductor chip 22. Thus, variation in respective output currents of semiconductor chips (driving currents of pixel circuits) can be reduced, compared to the known device. As a result, a display device for performing a more uniform display can be achieved.

In addition to this, in the display device of this embodiment, the reference current supply section and reference current input terminal 11 of a semiconductor chip are placed in the vicinity of part of the semiconductor chip facing a semiconductor chip in a previous stage and the current transmission MISFET and the reference current output terminal 9 are placed in the vicinity of part of the semiconductor chip facing a semiconductor chip in a subsequent stage.

Therefore, the distance between the reference current output terminal 9 and the reference current input terminal 11 is short. Thus, variation in currents output from the current supply section between semiconductor chips can be further suppressed. However, this effect of suppressing variation between semiconductor chips is lower than that obtained by providing reference current input/output terminals in the vicinity of an MISFET for transmitting a reference current. Therefore, the reference current output terminal 9 and the reference current input terminal 11 are not necessarily provided in one end of a semiconductor chip.

Note that in a semiconductor chip, property variation according to the location of a current supply section is smaller when the reference current supply section (or MISFET) is placed in a central portion of a chip than that when the reference current supply section is placed in one end of the chip. Accordingly, in this method, it is preferable that the reference current output terminal 9 and the reference current input terminal 11 are provided so as to be close to each other in the reference current supply section.

As has been described, with the semiconductor chips of this embodiment, property variation between the semiconductor chips can be suppressed. Therefore, a display device in which the generation of display distortion or the like is reduced can be achieved.

Note that a current mirror circuit formed of a p-channel MISFET may be provided between the first current transmission MISFET 7 and the reference current output terminal 9.

Figure 2:
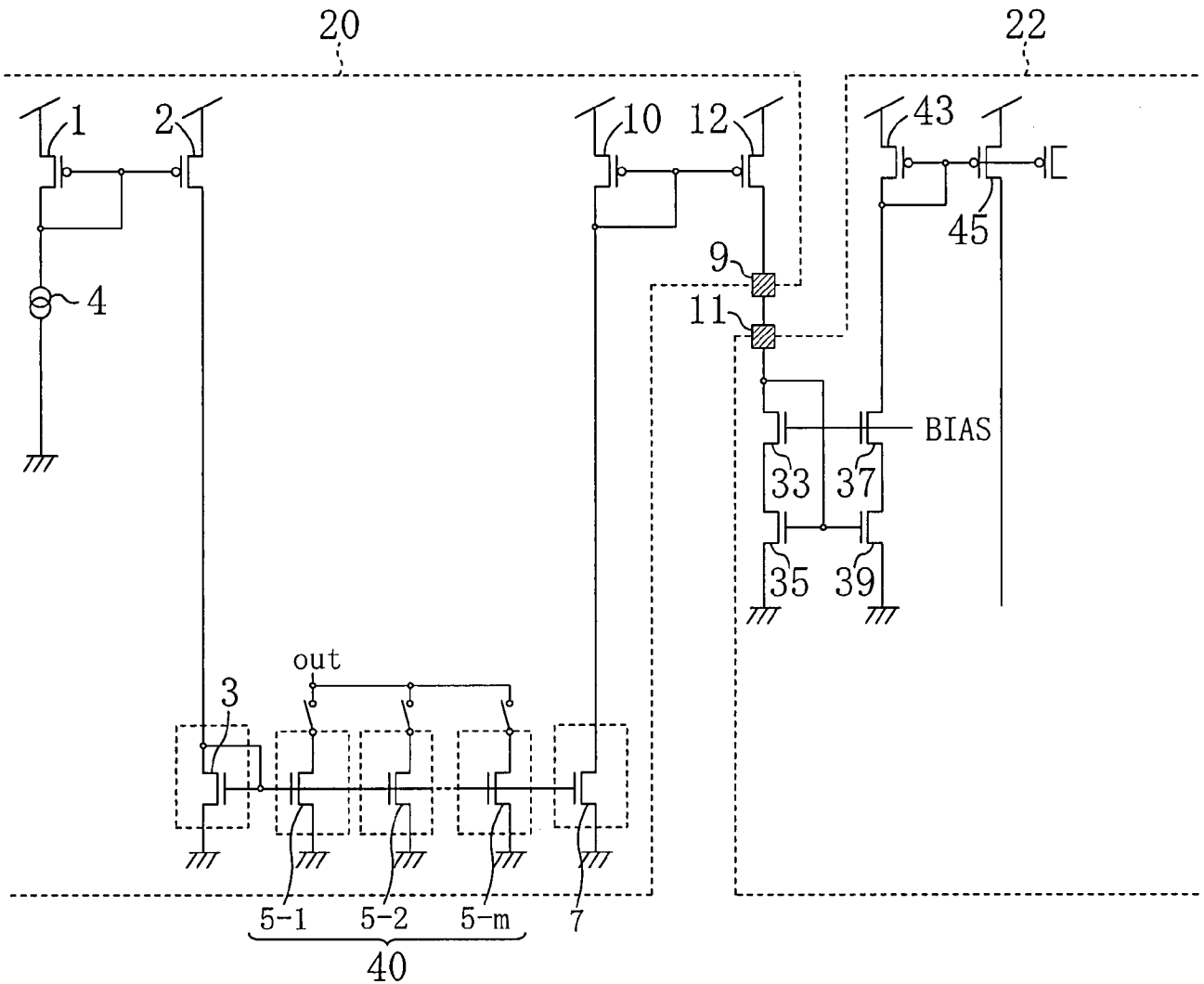
FIG. 2 is a circuit diagram illustrating a connection portion of two chips each including an example of the current driving device of the first embodiment.

FIG. 2 is a circuit diagram illustrating a connection portion of two chips each including an example of the current driving device according to the first embodiment.

In the exemplary current driving device of FIG. 2, a p-channel third current transmission MISFET 10 connected to the first current transmission MISFET. 7 and a p-channel fourth current transmission MISFET 12 constituting a current mirror circuit together with the third current transmission MISFET 10 are provided between the first current transmission MISFET 7 and the reference current output terminal 9 in the first semiconductor chip 20.

Moreover, the reference current supply section of the second semiconductor chip 22 has a configuration obtained by changing the conductive type of each of the MISFETs constituting the reference supplying section of FIG. 1 to the other conductive type. Specifically, in the second semiconductor chip 22, provided are an n-channel eighth MISFET 33 connected to the reference current input terminal 11, an n-channel ninth MISFET 35 which is cascoded to the eighth MISFET 33 and has a gate electrode connected to the reference current input terminal 11, an n-channel tenth MISFET 37 constituting a current mirror circuit together with the eighth MISFET 33, an n-channel eleventh MISFET 39 which is cascoded to the tenth MISFET 37 and constitutes a current mirror circuit together with the ninth MISFET 35, and a p-channel twelfth MISFET 43 for receiving a reference current flowing in the tenth MISFET 37. In this configuration, the distance between the reference current output terminal 9 of the first semiconductor chip 20 and each of the first current transmission MISFET 7, the third current transmission MISFET 10 and the fourth current transmission MISFET 12 is 200 μm or less. Also, each of the distance between the first current transmission MISFET 7 and the third current transmission MISFET 10 and the distance between the third current transmission MISFET 10 and the fourth current transmission MISFET 12 is 200 μm or less. Moreover, the distance between the reference current input terminal 11 and each of the eighth MISFET 33, the ninth MISFET 35, the tenth MISFET 37, the eleventh MISFET 39 and the twelfth MISFET 43 is 200 μm or less and the respective distances between the MISFETs are also 200 μm or less. In addition to this, the arrangement of the reference current input terminal 11 of the second semiconductor chip 22 and the reference current output terminal 9 of the first semiconductor chip 20 is not changed, i.e., the reference current input terminal 11 of the second semiconductor chip 22 and the reference current output terminal 9 of the first semiconductor chip 20 are placed so as to be close to each other. Thus, variation in output currents in each semiconductor chip can be suppressed to a low level.

Moreover, the respective reference current supply sections of the first semiconductor chips 20 of FIGS. 1 and 2 and the second semiconductor chips 22 of FIGS. 1 and 2 have slightly different configurations. However, in semiconductor chips used in a display device, the configurations of reference current supply sections may be formed the same.

Figure 3:
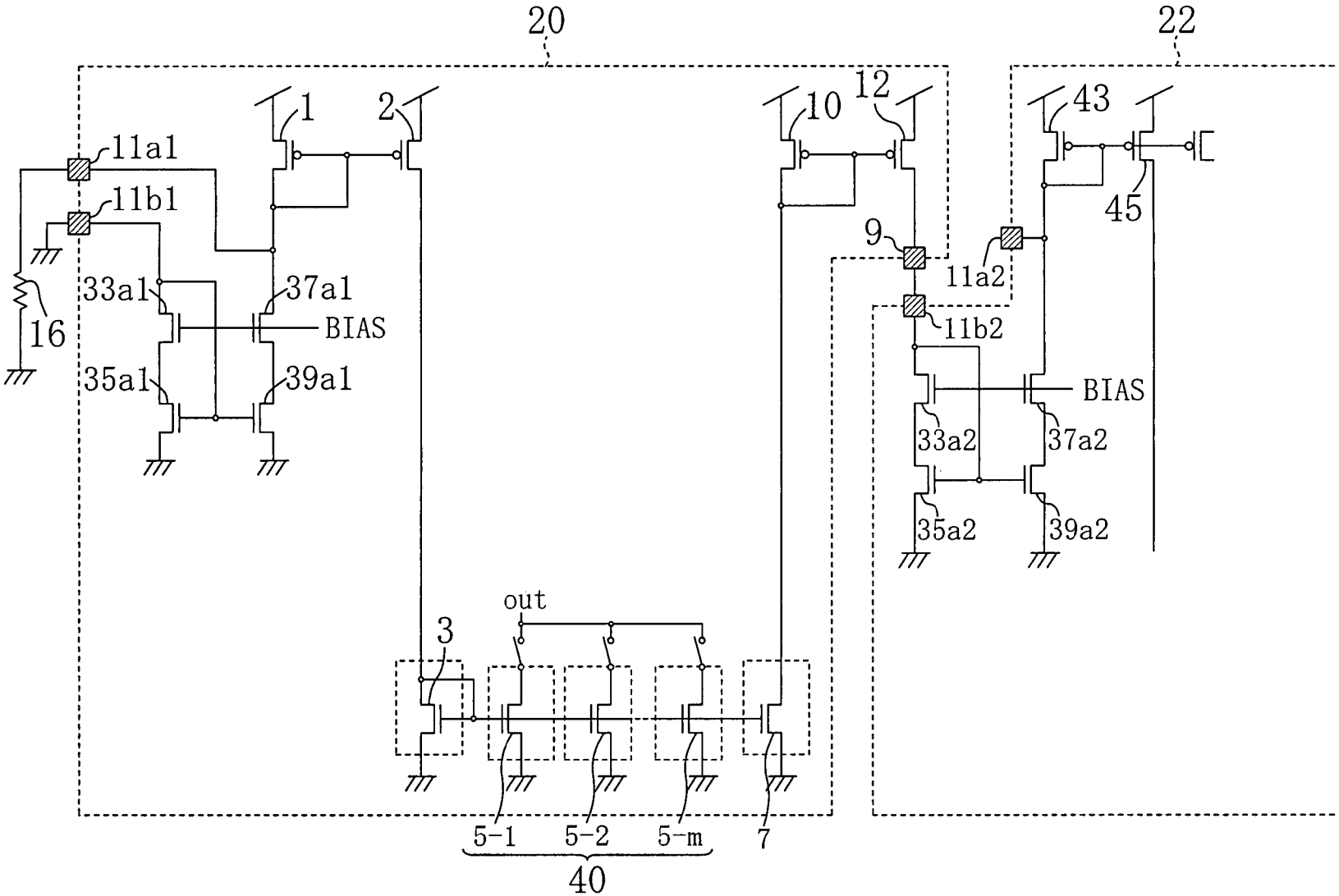
FIG. 3 is a circuit diagram illustrating a connection portion of two chips each including a current driving device according to a modified example of the first embodiment.

FIG. 3 is a circuit diagram illustrating a connection portion of two chips each including a current driving device according to a modified example of the first embodiment. In the modified example of the first embodiment of FIG. 3, a first reference current input terminal 11*a*1 and a second reference current input terminal 11*b*1 are provided in the vicinity of an end portion of the first semiconductor chip 20. Moreover, a reference current supply section has the same configuration as that of the reference current supply section of the second semiconductor chip 22 of FIG. 2 but is connected to the first reference current input terminal 11*a*1 and the second reference current input terminal 11*b*1 unlike the reference current supply section of the second semiconductor chip 22.

Specifically, in the first semiconductor of this modified example, provided are an n-channel eighth MISFET 33*a*1 connected to the second reference current input terminal 11*b*1, an n-channel ninth MISFET 35*a*1 which is cascoded to the eighth MISFET 33*a*1 and has a gate electrode connected to the first reference current input terminal 11*a*1, an n-channel tenth MISFET 37*a*1 constituting a current mirror circuit together with the eighth MISFET 33*a*1, an n-channel eleventh MISFET 39*a*1 which is cascoded to the tenth MISFET 37*a*1 and constitutes a current mirror circuit together with the ninth MISFET 35*a*1, and a p-channel first MISFET 1 for receiving a reference current flowing in the tenth MISFET 37*a*1. Then, each of respective gate electrodes of the first and second MISFETs 1 and 2, a drain of the first MISFET 1 and a drain of the tenth MISFET 37*a*1 is connected to the first reference current input terminal 11*a*1.

In this modified example, the first and second semiconductor chips 20 and 22 have the same configuration. However, in the first semiconductor chip 20, the first reference current input terminal 11*a*1 is connected to a grounded resistance 16 (or a reference current source) and the second reference current terminal 11*b*1 is grounded while in the second semiconductor chip 22, the first reference current input terminal 11*a*2 is in an open state and the second reference current input terminal 11*b*2 is connected to the reference current output terminal 9 of the first semiconductor chip 20.

With the semiconductor chips of this modified example, a display panel can be driven using chips of a single type. Therefore, fabrication costs for a display device can be reduced.

Note that in the exemplary semiconductor chips or current driving device described above, the MISFETs each constituting the current sources 5-1, 5-2, . . . and 5-*m* are of the n-channel type. However, the MISFETs can be operated in the same manner even if the MISFETs are of the p-channel type. In such a case, the conductive type of each of MISFETs constituting the reference current supply section and the current transmission MISFET may be changed to the other conductive type.

Note that when a plurality of semiconductor chips according to this modified example are cascaded, a resistance having the same resistance value as that of the resistance 16 may be connected to a reference current output terminal of a semiconductor chip to be the final stage.

Moreover, in the current driving device of this embodiment, a value for an current output from the reference current output terminal 9 of the first semiconductor chip 20 is not necessarily equal to a value for a reference current flowing in the reference current source 4. A current output from the reference current output terminal 9 is a reference current (referred to as a "second reference current) for the second semiconductor chip 22. Then, if a current mirror circuit having an appropriate mirror ratio is provided between the reference current input terminal 11 and the seventh MISFET 23, the same amount of a current can be supplied to each of the MISFETs in the current sources constituting the current supply section 40 and each of the MISFETs in the current sources constituting the current supply section 41.

Second Embodiment

Figure 4:
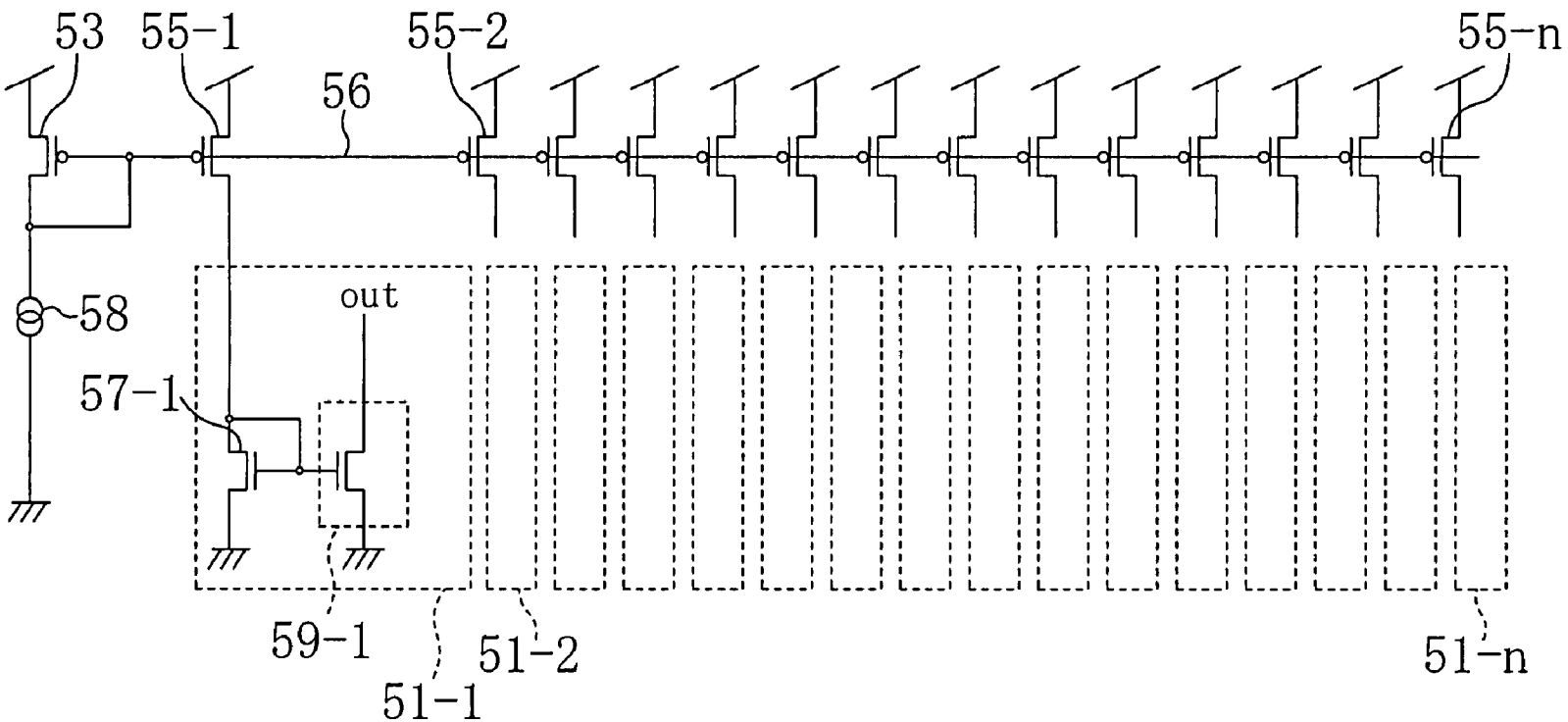
FIG. 4 is a circuit diagram illustrating a current driving device according to a second embodiment of the present invention.
Figures 21A, 21B, 21C, 21D:
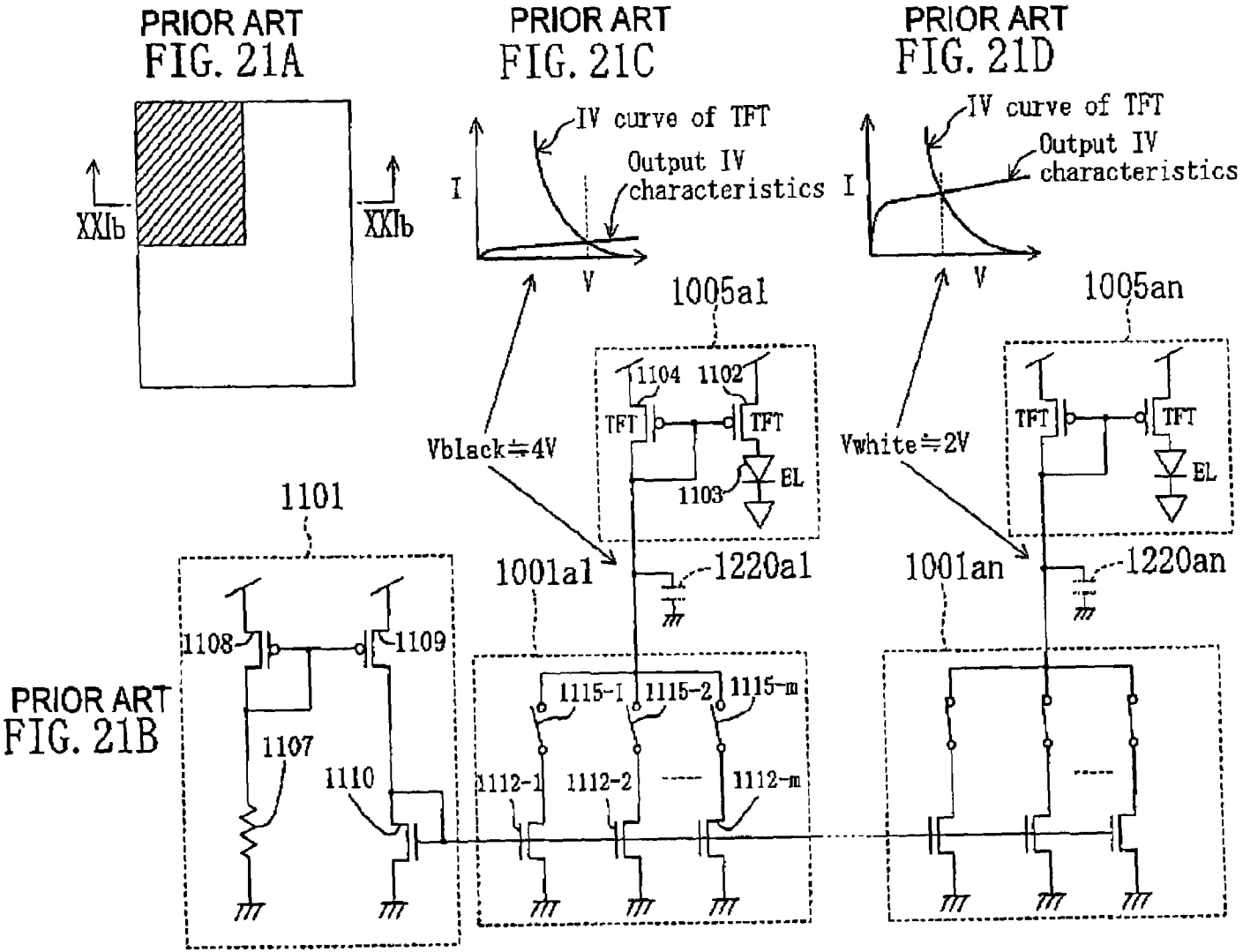
PRIOR ART FIG. 21A
PRIOR ART FIG. 21C
FIG. 21B PRIOR ART
FIG. 21A is a view illustrating an example of black and white displays in a display panel.
FIG. 21B is a circuit diagram illustrating the pixel circuits arranged along the line XXIb—XXIb of the display panel shown in FIG. 21A and-known current supply sections connected to the pixel circuits, respectively.
FIG. 21C is a graph showing an operating point of a TFT in a black display state.
FIG. 21D is a graph showing an operating point of a TFT in a white display state.
Figures 22A, 22B, 22C, 22D:
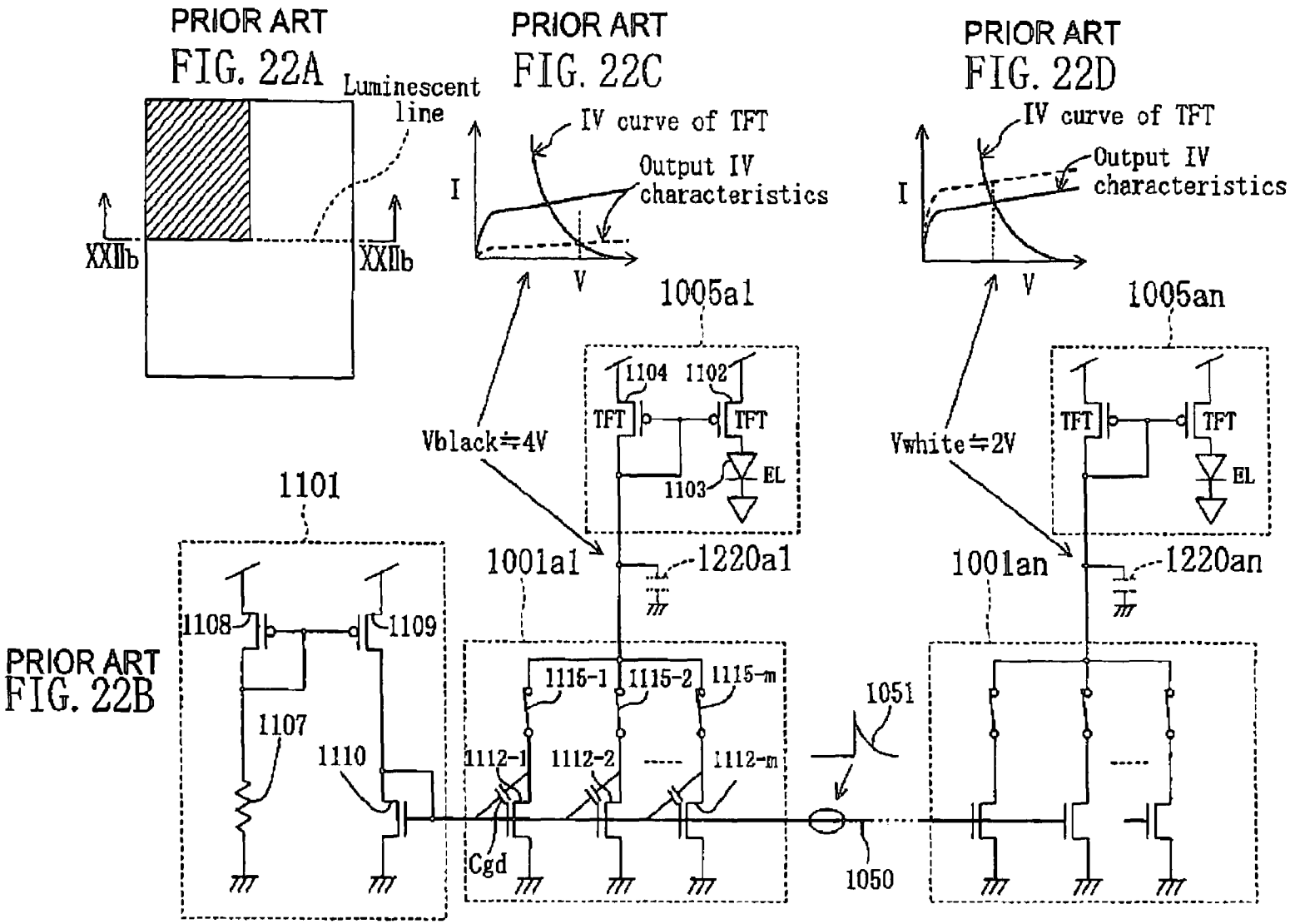
PRIOR ART FIG. 22A
PRIOR ART FIG. 22C
PRIOR ART FIG. 22D
PRIOR ART FIG. 22B
FIG. 22A is a view illustrating an example of black and white displays in a display panel.
FIG. 22B is a circuit diagram illustrating the pixel circuits arranged along the line XXIIb—XXIIb of the display panel shown in FIG. 22A and known current supply sections connected to the pixel circuits, respectively.
FIG. 22C is a graph showing an operating point of a TFT when a black display is changed to a white display.
FIG. 22D is a graph showing an operating point of the TFT when a white display is continuously performed.
Figure 23:
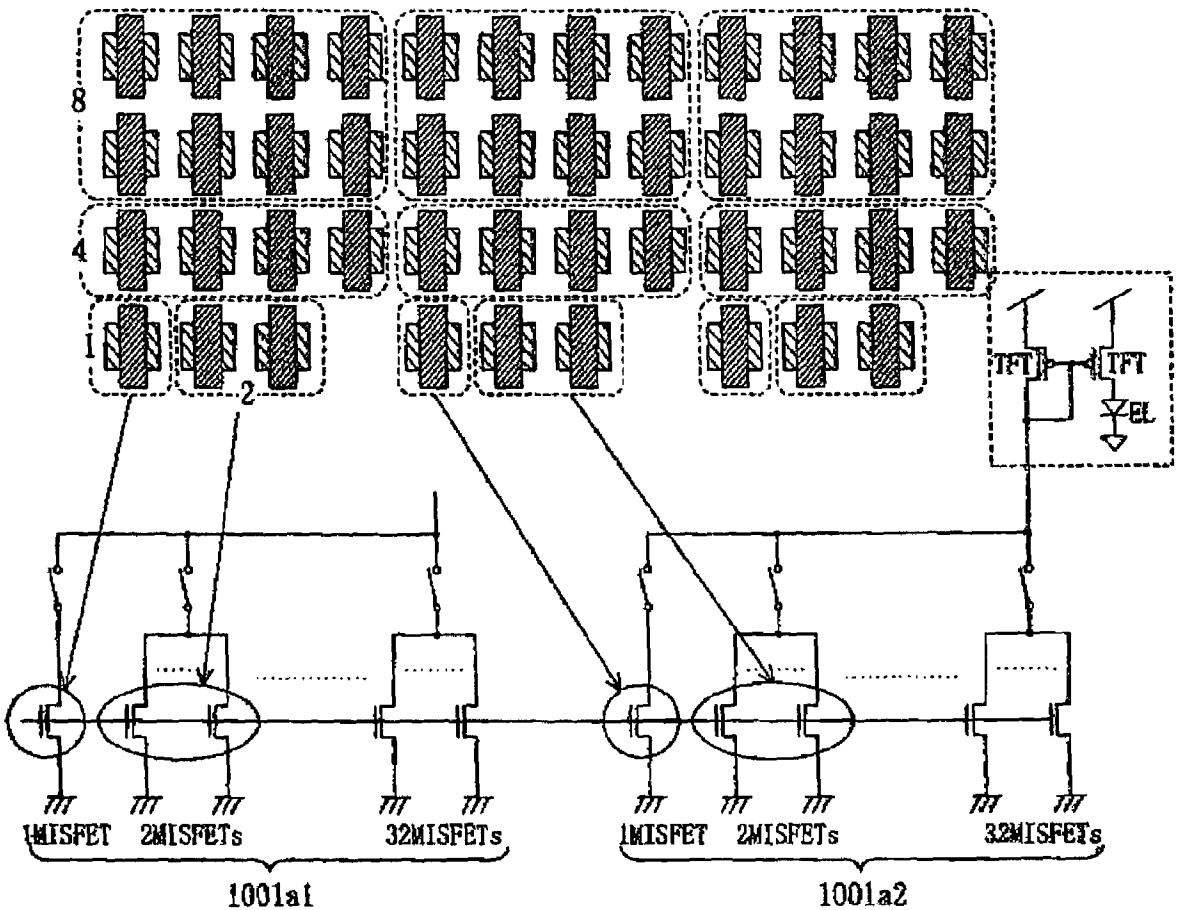
PRIOR ART FIG. 23
FIG. 23 is a circuit diagram illustrating the arrangement and configuration of a current supply section in the known current driving device.

FIG. 4 is a circuit diagram illustrating a current driving device according to a second embodiment of the present invention. The current driving device of this embodiment is characterized in that in addition to the components of the known current driving device shown in FIG. 21, current distribution MISFETs 55 and current input, MISFETs 57 for transmitting a reference current to each of current supply sections 59 are provided. In this case, a "current supply section 59" means to be each of the current supply sections 59-1 through 59-*m* shown in FIG. 4. A "current distribution MISFET 55" means to be each of current distribution MISFETs 55-1 through 55-*m* shown in FIG. 4. And a "current input MISFET 57" means to be each of current input MISFETs 57-1 through 57-*m* shown in FIG. 4.

As shown in FIG. 4, the current driving device of this embodiment includes a p-channel first MISFET 53, a reference current source 58 which is connected to the first MISFET 53 and generates a reference current, p-channel current distribution MISFETs 55-1, 55-2, . . . and 55-*n* which constitute a current mirror circuit together with the first MISFET 53 and distribute a reference current, n-channel current input MISFETs 57-1, 57-2, . . . and 57-*n* connected to the current distribution MISFETs 55-1, 55-2, . . . and 55-*n*, respectively, and current supply sections 59-1, 59-2, . . . and 59-*n* in which reference currents are transmitted from the current input MISFETs 57-1, 57-2, . . . and **57-*n* via a current mirror and which supply a driving current to pixel circuits (not shown). In this case, n is the number of outputs per a semiconductor chip. Moreover, respective gate electrodes of the first MISFET 53 and respective gate electrodes of the current distribution MISFETs 55-1, 55-2, . . . and 55-*n* are connected to a shared bias line 56**.

Moreover, the respective configurations of the current supply sections 59-1, 59-2, . . . and **59-*n* is substantially the same as those in the current supply section 40 (see FIG. 1) described in the first embodiment. For example, the current supply section 59-1 includes an current input MISFET 57-1 and m current sources each being formed of one or more MISFETs constituting a current mirror circuit together with the current input MISFET 57-1, and a switch (not shown) for turning ON or OFF a current flowing in the current source. However, respective gate electrodes of ones of the MISFETs constituting the current source which are connected to different output terminals do not have to be connected to one another, unlike the configuration of FIG. 4** and also may be connected to one another as described later.

When each of the current supply sections 59 includes m current sources, a $2^m$ gray scale display can be performed. In an example shown in FIG. 4, although not shown in FIG. 4, each of the current supply sections 59 includes current sources of 6 bits and is formed of 63 MISFETs having the same size. Note that in FIG. 4, each of the current supply sections 59 and the current input MISFET are shown as a unit referred to as a "current supply unit 51". In this case, the "current supply unit 51" means to be each of current supply units 51-1 through **51-*m***.

In the current driving device of this embodiment, the current distribution MISFET 55 and the current input MISFET 57 for distributing a reference current are provided in each of the current supply sections 59. Thus, when a display device changes its state from a black display state to a white display state, with a current flowing from the panel side, an operation of a current source in the current supply section 59 is hardly affected. Specifically, in the current driving device of this embodiment, the current distribution MISFETs 55 and the current input MISFETs 57 are provided in each current supply section, so that the number of gate electrodes of MISFETs connected to one unit of the current distribution MISFET 55 and the current input MISFET 57 is less than that in the known current driving device. Thus, the capacitance of a bias interconnect connecting a gate electrode of each of the current input MISFETs 57 and a gate electrode of one of the MISFETs constituting a current source of the current supply sections 59 is reduced. Accordingly, change in the potential of the gate electrode of the MISFETs constituting a current source in the current supply sections 59 can be easily absorbed. As a result, change in an output of each of the current supply sections 59 can be suppressed.

For the same reason, when a white display is changed to a black display, each of the current distribution MISFETs 55 is not affected and can distribute a constant current to the current supply sections 59 at all the time.

Accordingly, with the current driving device of this embodiment, change in a gate potential of current source MISFETs in the current supply sections 59 is rapidly converges during a display data writing period. Therefore, a current driving type display device in which the generation of a crosstalk is suppressed and less display distortion occurs can be achieved.

Moreover, the reference current input and output terminals described in the first embodiment are provided in a semiconductor chip in which the current driving device of this embodiment is provided, thereby achieving a display device in which display distortion and nonuniformity can be further suppressed.

Figure 5:
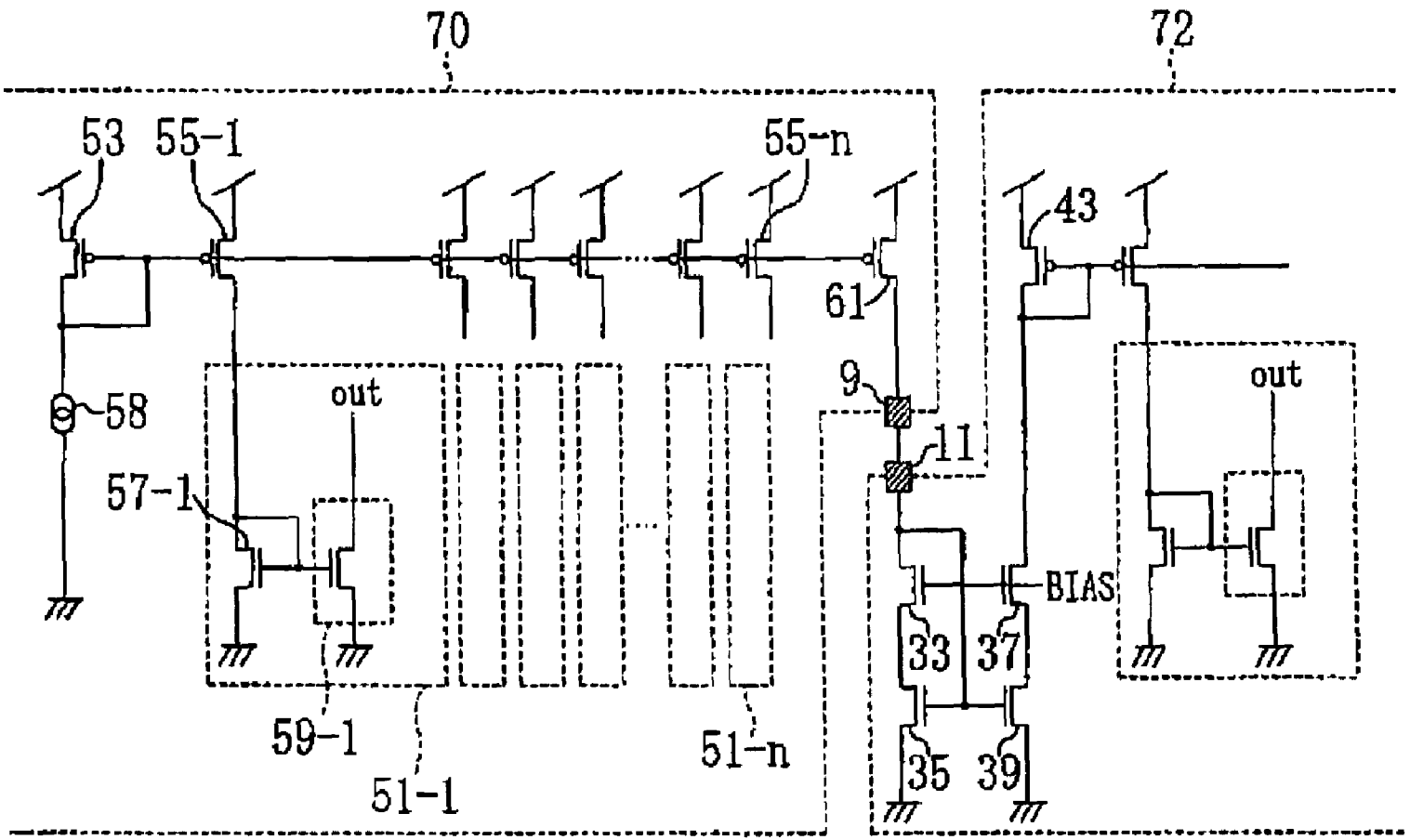
FIG. 5 is a diagram illustrating semiconductor chips according to the second embodiment in the case where each of reference current input and output terminals is provided at one end and another of each of the semiconductor chips, respectively.

FIG. 5 is a diagram illustrating semiconductor chips according to this embodiment in the case where each of reference current input and output terminals is provided at one end of each of the semiconductor chips.

In each of a first semiconductor chip 70 and a second semiconductor chip 72, the current driving device of this embodiment, which has been described, is provided. Then, in the first semiconductor chip 70, provided are a p-channel current transmission MISFET 61 constituting a current mirror circuit together with the distribution MISFETs 55 and the first MISFET 53, and a reference current output terminal 9 connected to a current transmission MISFET 61.

On the other hand, in the second semiconductor chip 72, provided are a reference current input terminal 11 connected to a reference current output terminal 9, an n-channel eighth MISFET 33 connected to the reference current input terminal 11, an n-channel ninth MISFET 35 which is cascoded to the eighth MISFET 33 and has a gate electrode connected to the reference current input terminal 11, an n-channel tenth MISFET 37 constituting a current mirror circuit together with the eighth MISFET 33, an n-channel eleventh MISFET 39 which is cascoded to the tenth MISFET 37 and constitutes a current mirror circuit together with the ninth MISFET 35, a p-channel twelfth MISFET 43 for receiving a reference current flowing in the tenth MISFET 37, and the reference current terminal 9 (not shown). Note that in this case, each member also shown in FIG. 2 in the first embodiment is identified by the same name and the same reference numeral.

Moreover, the reference current output terminal 9 is placed, for example, in the vicinity of an end portion of each of the first and second semiconductor chips 70 and 72. Furthermore, the distance between the reference current output terminal 9 and the current transmission MISFET 61 is about 100 μm or less. Moreover, the reference current input terminal 11 is placed, for example, in the vicinity of an end portion of the second chip 72 so as to face the reference current output terminal 9 of the first semiconductor chip 70. Then, the distance between the reference current input terminal 11 and an MISFET such as the twelfth MISFET 43 constituting a reference current supply section is about 100 μm or less.

A reference current generated in the reference current source 58 and the first MISFET 53 is transmitted to the current transmission MISFET 61 via a current mirror and is output from the reference current output terminal 9. Subsequently, the reference current is input to the reference current input terminal 11 and is input to the twelfth MISFET 43 via the eighth MISFET 33, the ninth MISFET 35, the tenth MISFET 37 and the eleventh MISFET 39. Then, the reference current is transmitted to a current transmission MISFET (not shown) which is provided on the second semiconductor chip 72 and constitutes a current mirror circuit together with the twelfth MISFET 43. The reference current transmitted to the current transmission MISFET is further transmitted to a semiconductor chip in a subsequent stage via the reference current output terminal 9 (not shown).

With the above-described configuration, a reference current with a small error is transmitted from the reference current output terminal 9 to the reference current input terminal 11, the reference current output terminal 9 and the reference input terminal 11 being close to each other. Thus, it is possible to suppress the generation of a crosstalk and also suppress variation in output currents in each semiconductor chip including a current driving device to a low level in a semiconductor chip.

Accordingly, with the above-described input/output configuration of a reference current, an image display with less nonuniformity can be achieved. Therefore, a large-size and high definition organic EL or LED display panel or the like can be achieved.

Moreover, although not shown in FIG. 5, with the reference current supply section having the same configuration as that of the example of FIG. 3, semiconductor chips of only one type can be used in a display device. Therefore, fabrication costs for the display device can be reduced.

Note that in the current driving device of this embodiment, the example in which the current distribution MISFETs 55 and the current input MISFETs 57 are provided in each of the current supply sections 59 is shown in FIG. 4. However, a unit of the current distribution MISFET 55 and the current input MISFET 57 may be provided in every two or more current supply sections 59. In such a case, two or more units of the current distribution MISFET 55 and the current input MISFET 57 can be provided in each semiconductor chip. The greater the number of current distribution MISFETs 55 is, the greater the effect of suppressing a crosstalk becomes. However, in an actual circuit, it is preferable to take a balance between circuit area and performance of the circuit in designing the circuit.

Figure 6:
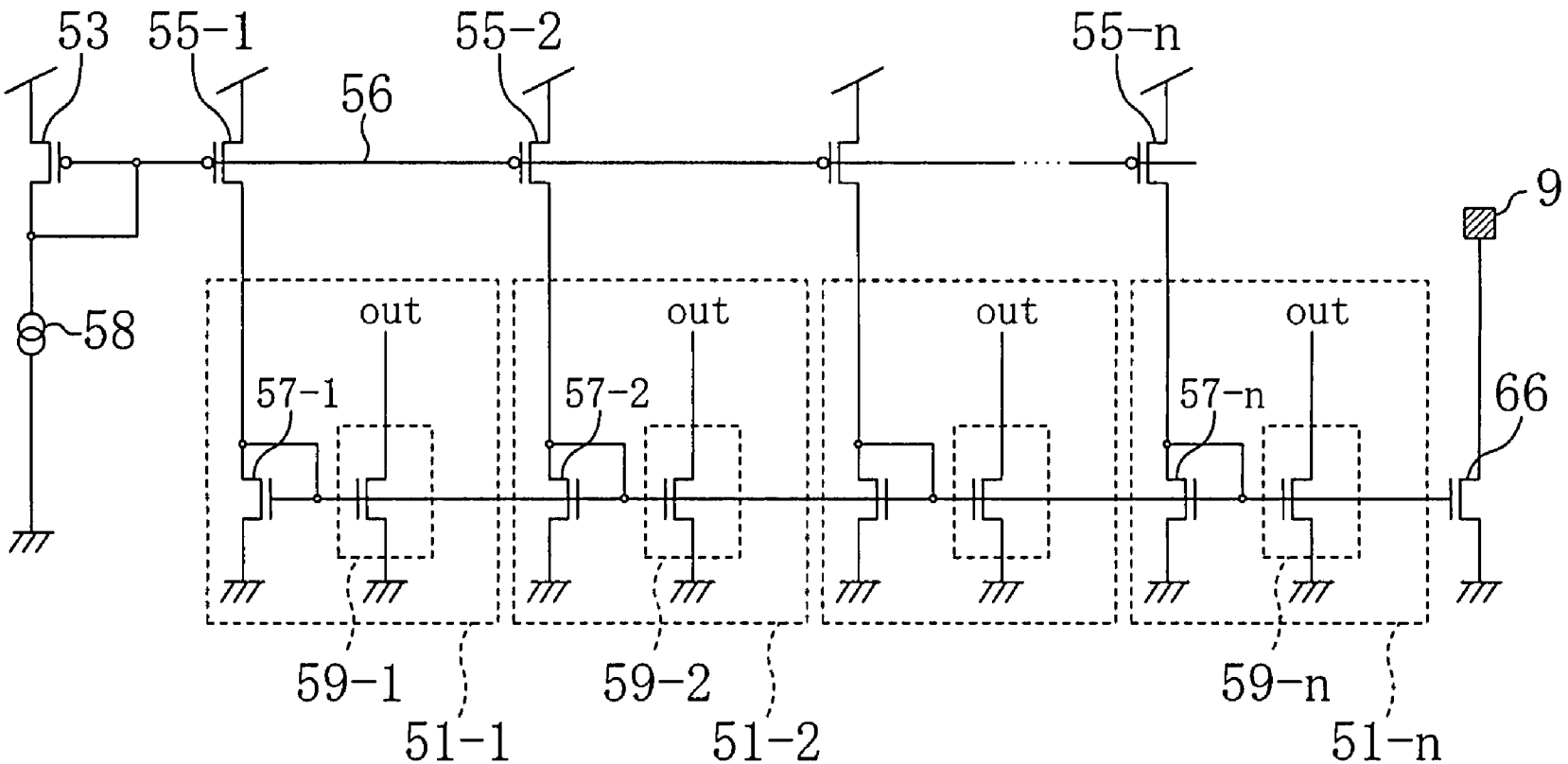
FIG. 6 is a circuit diagram illustrating a modified example of the current driving device of the second embodiment.

FIG. 6 is a circuit diagram illustrating a modified example of the current driving device of this embodiment. In a semiconductor chip, respective thresholds Vt of MISFETs arranged along the direction from a reference current input terminal to a reference current output terminal (i.e., the longitudinal direction of the chip) are graded due to an impurity-concentration gradient and the like, for example, so that the thresholds of ones of the MISFETs closer to the input terminal are high whereas the thresholds of ones of the MISFETs closer to the output terminal are low.

Then, as shown in FIG. 6, in the current driving device of this embodiment, respective gate electrodes of ones of the MISFETs for constituting current sources in the current supply sections 59-1 through **59-*n* connected to different output terminals may be connected to one another, and also gate electrodes of the current input MISFETs 57 connected to different output terminals may be connected to one another. In such a case, a voltage may be applied to each of the gate electrodes of the MISFETs so that applied voltages are graded according to the gradient of the thresholds of the MISFETs. Thus, variation in currents output from the current supply sections 59 can be reduced. Note that in this modified example, an n-channel current transmission MISFET 66 constituting a current mirror circuit together with each of the current input MISFETs 57 and MISFETs in each of the current supply sections 59, and a reference current output terminal 9 connected to the current transmission MISFET 66 are provided to be connected to a semiconductor chip in a subsequent stage. At this time, if the current transmission MISFET 66 and the reference current output terminal 9 are placed in the vicinity of an end portion of a semiconductor chip, variation in output currents in each semiconductor chip can be reduced as in the example of FIG. 3**.

Third Embodiment

Figure 7:
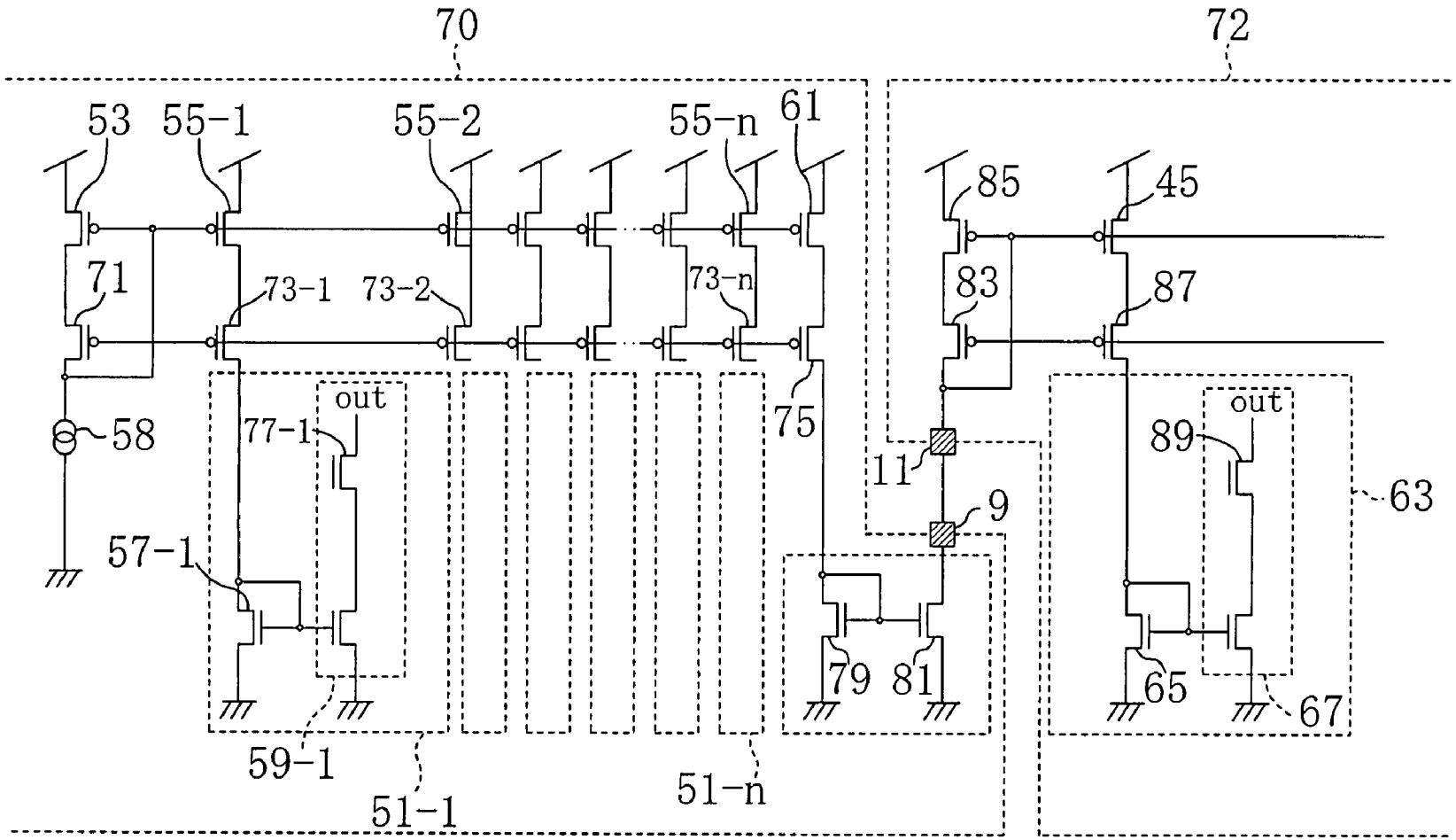
FIG. 7 is a circuit diagram illustrating a current driving device according to a third embodiment of the present invention.
Figure 8A:
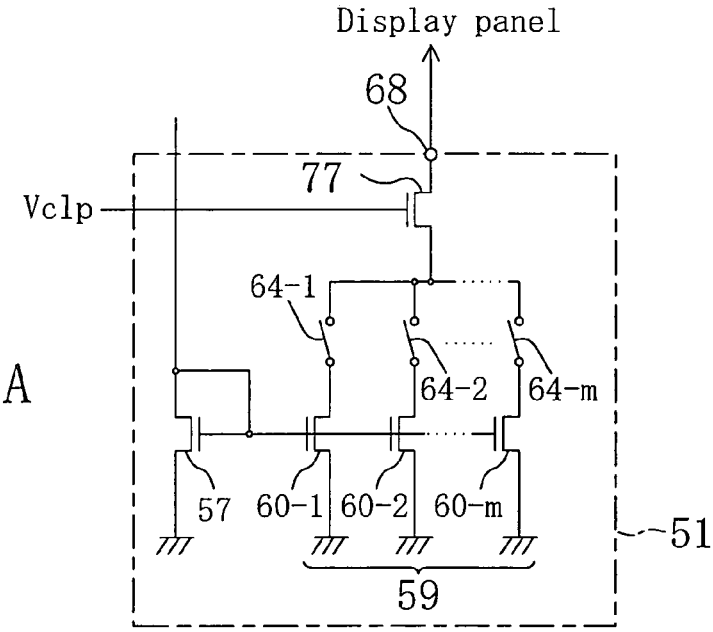
FIGS. 8A and 8B are enlarged circuit diagrams illustrating exemplary configurations for a current supply unit 51 in the current driving device of the third embodiment.
Figure 8B:
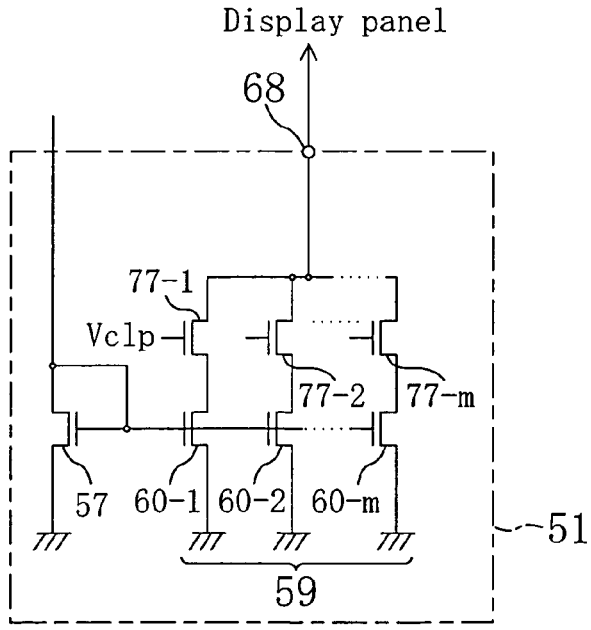

FIG. 7 is a circuit diagram illustrating a current driving device according to a third embodiment of the present invention. FIGS. 8A and 8B are enlarged circuit diagrams illustrating exemplary configurations for a current supply unit 51 in the current driving device of this embodiment.

As shown in FIG. 7, the current driving device of this embodiment includes a plurality of current distribution MISFETs as in the current driving device of the second embodiment. However, the current driving device of this embodiment is different from that of the second embodiment in the following points. Those points are features of the current driving device of this embodiment.

First, a first feature of the current driving device of this embodiment is that an n-channel cascode MISFET 77 to be cascoded to one or more n-channel MISFETs serving as a current source in each of the current supply sections 59 is provided. In FIG. 7, a simplified configuration of each of the current supply sections 59 is illustrated. However, each of the current supply section 59 actually has a configuration shown in FIG. 8A or 8B.

In an example shown in FIG. 8A, for current sources 60-1, 60-2, . . . and **60-*m* of m bits, a cascode MISFET 77 is provided via switches 64-1, 64-2, . . . and 64-*m*. A gate voltage Vclp of the cascode MISFET 77 is set at a lower level than a power supply voltage (e.g., about 3 V) of a display panel. Moreover, the threshold of the cascode MISFET 77 is equal to or lower than the gate voltage Vclp and the cascode MISFET 77** is in an ON state during an entire driving period.

Thus, the cascode MISFET 77 functions as a clamp circuit and can limit a current inflow from the panel side when non-conductive states of the switches 64-1, 64-2, . . . and **64-*m* are changed to conductive states at a time. Specifically, the gate voltage Vclp is set at a lower level than the power supply voltage of the display panel, so that-even with a high voltage momentarily applied to an output terminal 68 from the display panel side, a voltage applied to the drain of each of the MISFETs constituting the current sources 60-1, 60-2, . . . and 60-*m*, respectively, can be made equal to or lower than the gate voltage Vclp. Accordingly, the gate potential of each of the MISFETs constituting the current sources 60-1, 60-2, . . . and 60-*m***, respectively, is hardly affected by change in current inflow from the display panel. Therefore, in the current driving device of this embodiment, the generation of a crosstalk display can be suppressed, thus achieving a uniform display.

Note that as current control means, a resistance element such as polysilicon resistance, diffusion resistance, well resistance and the like may be provided, instead of the cascode MISFET 77. In a semiconductor integrated circuit, in general, a current limiting resistance for preventing an inflow of charge from the outside is provided to protect an internal circuit from electrostatic destruction. In this case, the resistance limits an inflow of charge from the display panel and removes high-frequency components. Then, high-frequency components have been removed, so that a parasitic capacitance between the drain and gate of each of the MISFETs serving as a current source can be reduced. Therefore, change in the gate potential due to charge inflow from the panel can be suppressed.

Moreover, a current supply section in the current driving device of this embodiment may have the configuration shown in FIG. 8B. In this example, cascode MISFETs 77-1, 77-2, . . . and **77-*m* are provided, instead of switches (corresponding to the switches 64-1 through 64-*m* in FIG. 8A) for controlling the amount of a current flowing in each of the current supply sections 59. The gate voltage Vclp lower than the power supply voltage of the display panel is applied to each of the cascode MISFETs 77-1, 77-2, . . . and 77-*m* to turn ON each of the cascode MISFETs 77-1, 77-2, . . . and 77-*m*. Note that each of the cascode MISFETs 77-1, 77-2, . . . and 77-*m* also functions as an output control switch of each of the current supply sections 59. Accordingly, the cascode MISFET 77-1, 77-2, . . . and 77-*m*** are controlled to be ON or OFF according to display data.

Thus, the cascode MISFETs 77-1, 77-2, . . . and **77-*m* function to prevent a rapid flow of a high current in the current sources of each of the current supply sections 59 when a black display is changed to a white display and the like. Furthermore, with this configuration, a circuit area can be reduced, compared to the example of FIG. 8**A. Therefore, the current driving device of this embodiment is preferably used for a display device including a driver LSI of which the area is required to be small.

Next, a second feature of the current driving device of this embodiment is that second current distribution MISFETs 73 each of which is cascoded to on associated one of current distribution MISFETs 55 and has the same conductivity type as that of the current distribution MISFETs 55 is provided between the associated one of the p-channel current distribution MISFETs 55 and an associated one of current input MISFETs 57. Thus, the current driving device of this embodiment includes a p-channel thirteenth MISFET 71 provided between the drain of a first MISFET 53 and a reference current source 58, and a p-channel fourth current transmission MISFET 75 which is cascoded to the current transmission MISFET 61 and constitutes a current mirror circuit together with the thirteenth MISFET 71. Each of gate electrodes of the second current distribution MISFETs 73 is connected to a shared bias line and the second current distribution MISFETs 73 constitutes a current mirror circuit together with the thirteenth MISFET 71 and the fourth transmission MISFET 75. Herein, the "second current distribution MISFETs 73" is an expression used when the second current distribution MISFETs 73-1 through **73-*m*** are not distinguished from one another.

With the above-described configuration, in the current driving device of this embodiment, change in a reference current transmitted to each of the current sources 60-1 through **60-*m* of each of the current supply sections 59 via each of the current input MISFETs 57** is suppressed and thus stabilized. Therefore, with the current driving device of this embodiment, display quality of the current driving type display device can be further improved.

Next, a third feature of the current driving device of this embodiment is that a reference current output terminal 9 is provided in the vicinity of an end portion of the semiconductor chip 70 and a reference current input terminal 11 is provided in the vicinity of the semiconductor chip 72 and n-channel current transmission MISFETs 79 and 81 together constituting a current mirror circuit are provided in the vicinity of the end portion of the semiconductor chip 70. Furthermore, in an example shown in FIG. 7, when the reference current source 58 is located outside of the first semiconductor chip 70 and a reference current input terminal is provided between the reference current source 58 and the drain of the thirteen MISFET 71, the first and second semiconductor chips 70 and 72 can be made to have the same configuration.

Thus, variation in output currents between semiconductor chips can be suppressed and also a driver of a display device can be formed of semiconductor chips of a single type.

Note that the example of the current driving device of this embodiment which has the above-described three features has been described. However, even when the current driving device has one or two of these features, a more uniform display can be achieved, compared to the known current driving device.

Note that in the current driving device of this embodiment, the conductive type of each of the MISFETs in each of the current supply sections 59 may be the p-channel, and the potential in the current supply sections 59 side may be higher than that of the display panel. In such a case, the conductive type of each of the MISFETs constituting the current driving device can be changed to the other conductive type. This can be done in the following embodiments as well.

Fourth Embodiment

Figure 9:
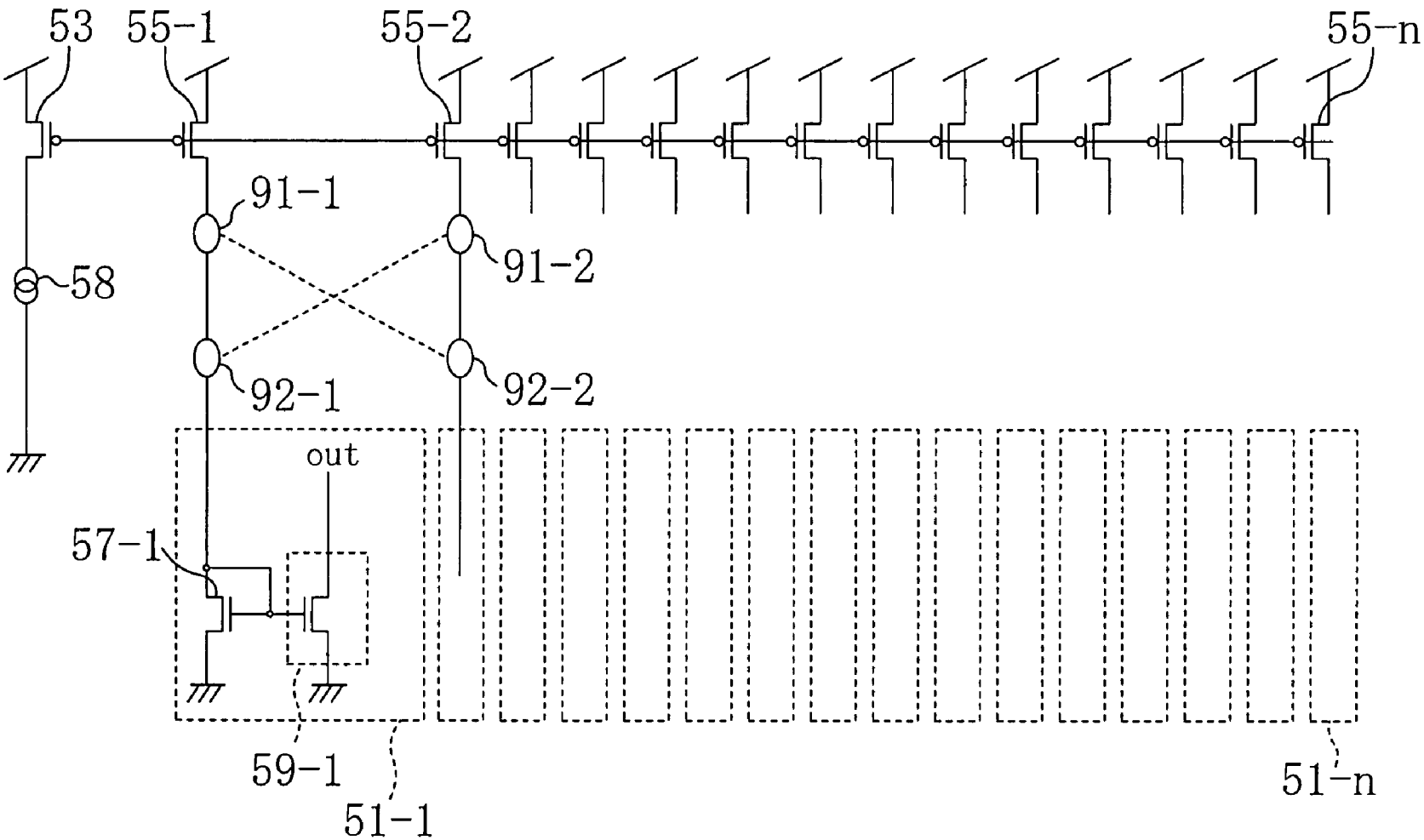
FIG. 9 is a circuit diagram illustrating a current driving device according to a fourth embodiment of the present invention.

FIG. 9 is a circuit diagram illustrating a current driving device according to a fourth embodiment of the present invention.

As shown in FIG. 9, the current driving device of this embodiment is characterized in that in the current driving device of the second embodiment, a reference current distributed by a current mirror including the current distribution MISFETs 55 is arbitrarily changed (i.e., shuffled) output from an output terminal of each of the current supply sections 59. Thus, the internal circuit configuration of each of the current supply units 51-1 through **51-*n*** in the current driving device of this embodiment is the same as that in the second embodiment.

In an example of the current driving device of this embodiment shown in FIG. 9, each of the current distribution MISFETs 55 is provided for each of the current supply sections 59 and first and second bias current changing switches 91 and 92 are provided between the drain of each of the current distribution MISFETs 55 and each of the current input MISFETs 57. For example, first and second bias current changing switches 91-1 and 92-1 are provided between a current distribution MISFET 55-1 and a current input MISFET 57-1 and first and second bias current changing switches 91-2 and 92-2 are provided between a current distribution MISFET 55-2 and a current input MISFET 57-2.

With this configuration, a reference current distributed by each of current distribution MISFETs 55-1 through **55-*n* can be output from a different output terminal of the current supply sections 59 in every arbitrary period. A timing of changing connections between the first bias current changing switches 91 and the second bias current changing switches 92** can be arbitrarily set, for example, every n lines (n is a positive integer), every frame or the like.

Figure 10A:
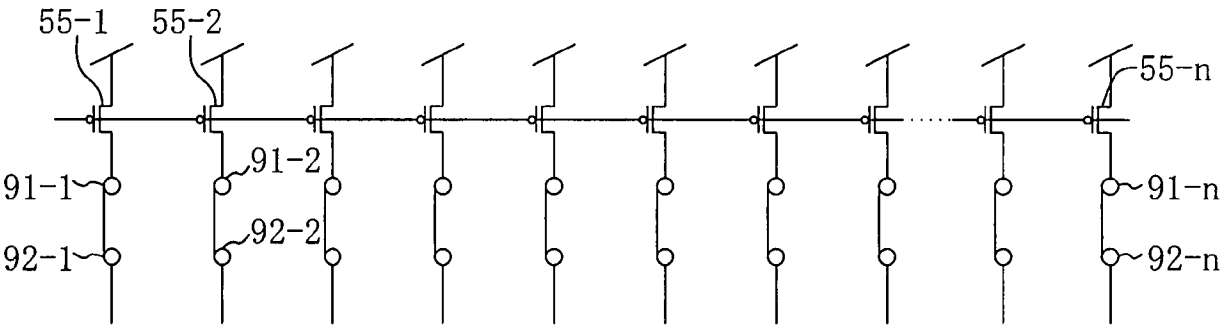
FIGS. 10A, 10B and 10C are circuit diagrams illustrating an example of output changing methods in the current driving device of the fourth embodiment.
Figure 10B:
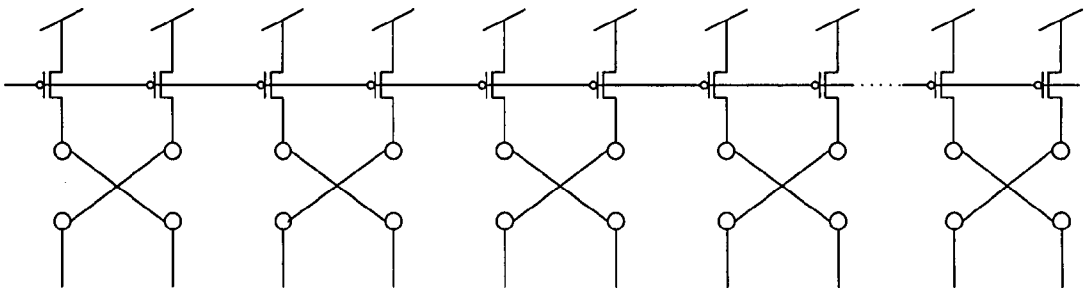
Figure 10C:
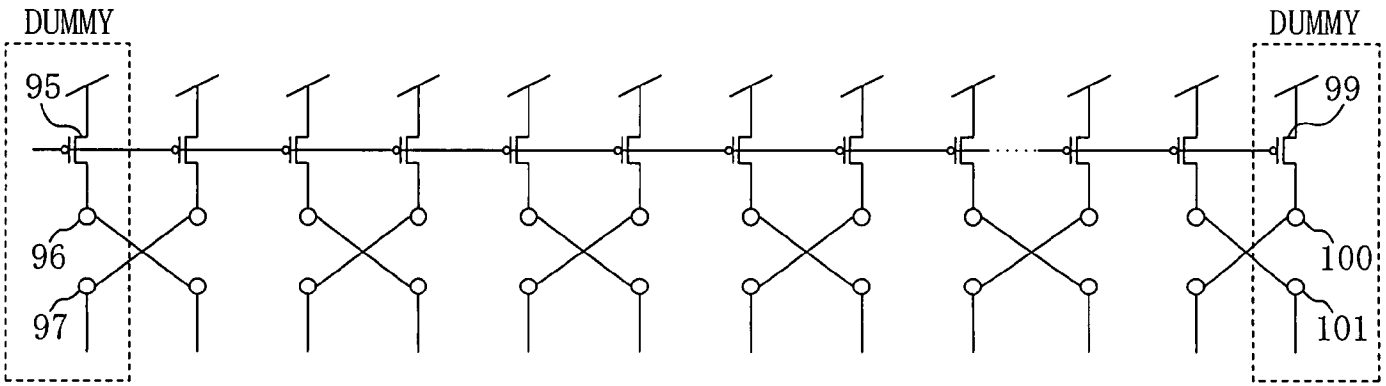
Figure 11A:
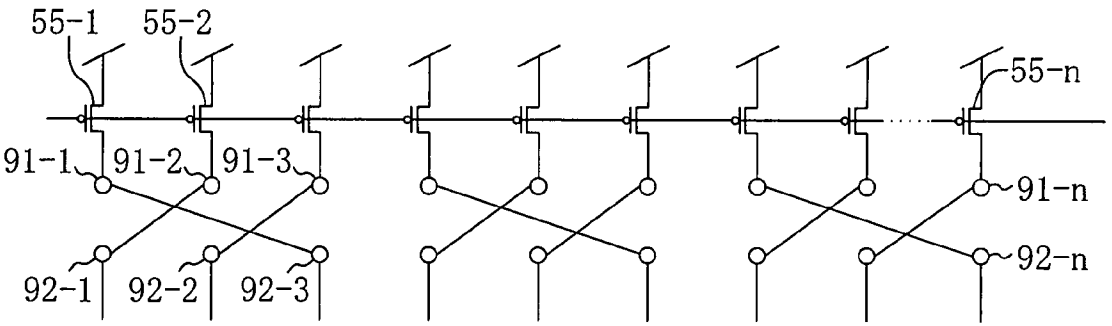
FIGS. 11A, 11B and 11C are circuit diagrams illustrating another example of output changing methods in the current driving device of the fourth embodiment.
Figure 11B:
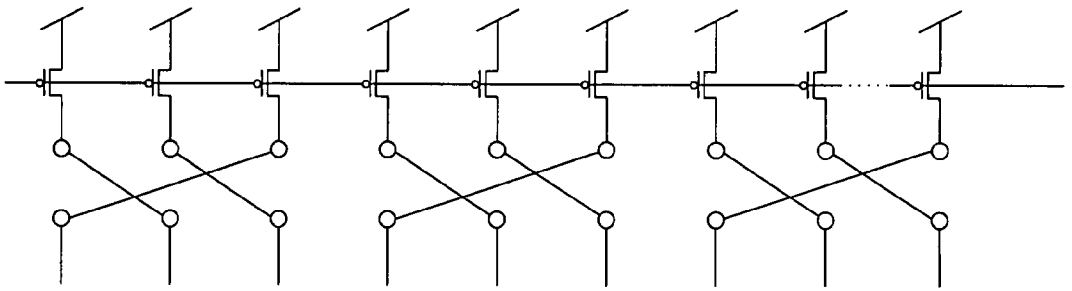
Figure 11C:
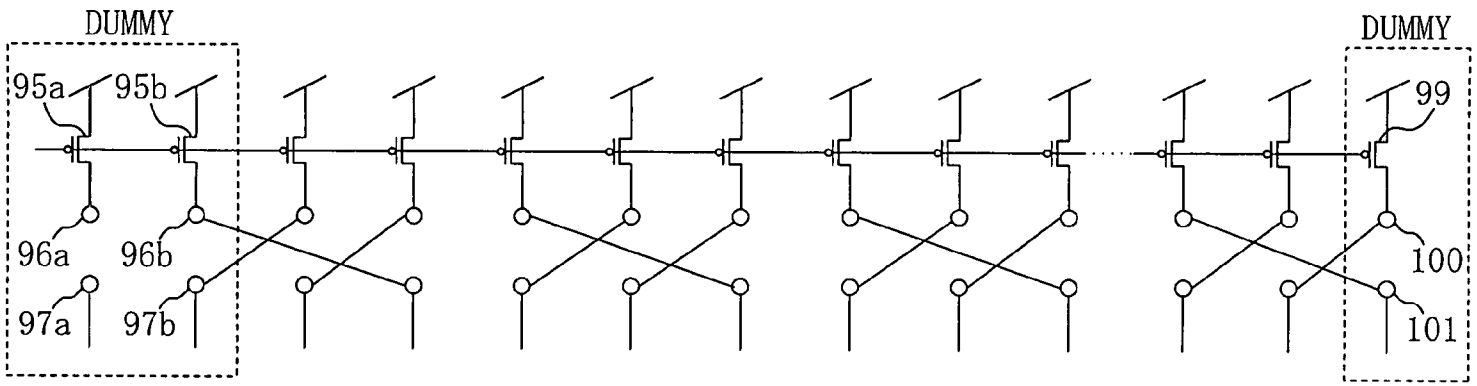

FIGS. 10A, 10B and 10C are circuit diagrams illustrating an example of output changing methods in the current driving device of this embodiment. FIGS. 11A, 11B and 11C are circuit diagrams illustrating another example of output changing methods in the current driving device of this embodiment.

Focusing on one of the current distribution MISFETs 55, FIGS. 10A, 10B and 10C illustrate a method for changing connections of the current distribution MISFETs 55 to the current supply units 51. If connections are changed among the current distribution MISFETs 55, dummy current distribution MISFETs 95 and 99 can be provided next to the current distribution MISFET 55-1 and the current distribution MISFET **55-*n*, respectively, so that the current distribution MISFETs 55-1 through 55-*n* are interposed between the dummy current distribution MISFETs 95 and 99. In this case, dummy bias current changing switches 96, 97, 100 and 101** are also provided.

The current distribution MISFET 55-1 will be taken as an example to describe this method. Here, an example in which connection change is performed in every horizontal scanning period will be described.

First, in an initial horizontal scanning period, the current distribution MISFET 55-1 is connected to the current supply unit 51-1 in a normal manner as shown in FIG. 10A.

In the subsequent horizontal scanning period, the current distribution MISFET 55-1 is connected to the current supply unit 51-2 as shown in FIG. 10B.

In a further subsequent horizontal scanning period, the current distribution MISFET 55-1 is connected to a dummy interconnect as shown in FIG. 10C. Note that only the current distribution MISFET 55-1 has been described herein, but connections in other part of the current distribution MISFETs 55 are also changed in the same manner.

As described above, the relationship between the current distribution MISFETs 55 and an output current can be changed in three different ways. Thus, variation in properties of the current distribution MISFETs 55 can be cancelled off. Therefore, with the current driving device of this embodiment, a current driving type display device in which display flicker is suppressed can be achieved. Note that in the example of FIG. 10, three connection changing patterns of FIGS. 10A, 10B and 10C are used. However, more than three patterns may be used or only two patterns shown in FIGS. 10B and 10C may be used.

Moreover, the current driving device of this embodiment can perform another connection changing method shown in FIGS. 11A, 11B and 11C.

Specifically, in an initial horizontal scanning period, the current distribution MISFET 55-1 is connected to a current supply unit 51-3 as shown in FIG. 11A.

Then, in the subsequent horizontal scanning period, the current distribution MISFET 55-1 is connected to a current supply unit 51-2 as shown in FIG. 11B.

In a further subsequent horizontal scanning period, the current distribution MISFET 55-1 is connected to a dummy bias current changing switch 97*b* as shown in FIG. 11C. In this connection changing method, an error in output currents from the current supply sections 59 is apparently cancelled off.

Note that in the current driving device of this embodiment, the connection changing method for changing a connection of the current distribution MISFETs 55 is not limited to the methods described above, but the current supply units 51 in which connections of the current distribution MISFETs 55-1 through 55-*n* take place can be arbitrarily changed. However, each of the current distribution MISFETs 55 is more preferably connected to each of the second bias current changing switches 92 located in the vicinity of the current distribution MISFETs 55 as possible because an interconnect can be short and simplified with such a connection. Therefore, it is the most preferable to change a connection between current distribution MISFETs 55 located adjacent to each other.

Note that in the current driving device of this embodiment, the bias current changing switches 91 and 92 for changing a connection between output terminals is provided between each of the distribution MISFETs 55 and each of the current input MISFETs 57. However, the first and second bias current changing switches 91 and 92 may be provided between the drain of the n-channel MISFETs constituting each of the current supply section 59-1 and each of the switches 64 (see FIG. 8).

Moreover, in the current driving device shown in FIGS. 9 through 11, a switch (or a connection changing terminal) is used as the connection changing means for changing the connection between each of the current distribution MISFETs 55 and each of the current input MISFETs 57. However, some other connection changing means may be provided.

Note that in the current driving device of this embodiment, when a circuit area is limited, the current distribution MISFETs 55 and the current input MISFETs 57 may be provided so that one current distribution MISFET 55 and one current input MISFET 57 are located per a plurality of the current supply sections 59.

Modified Example of Fourth Embodiment

Figure 12:
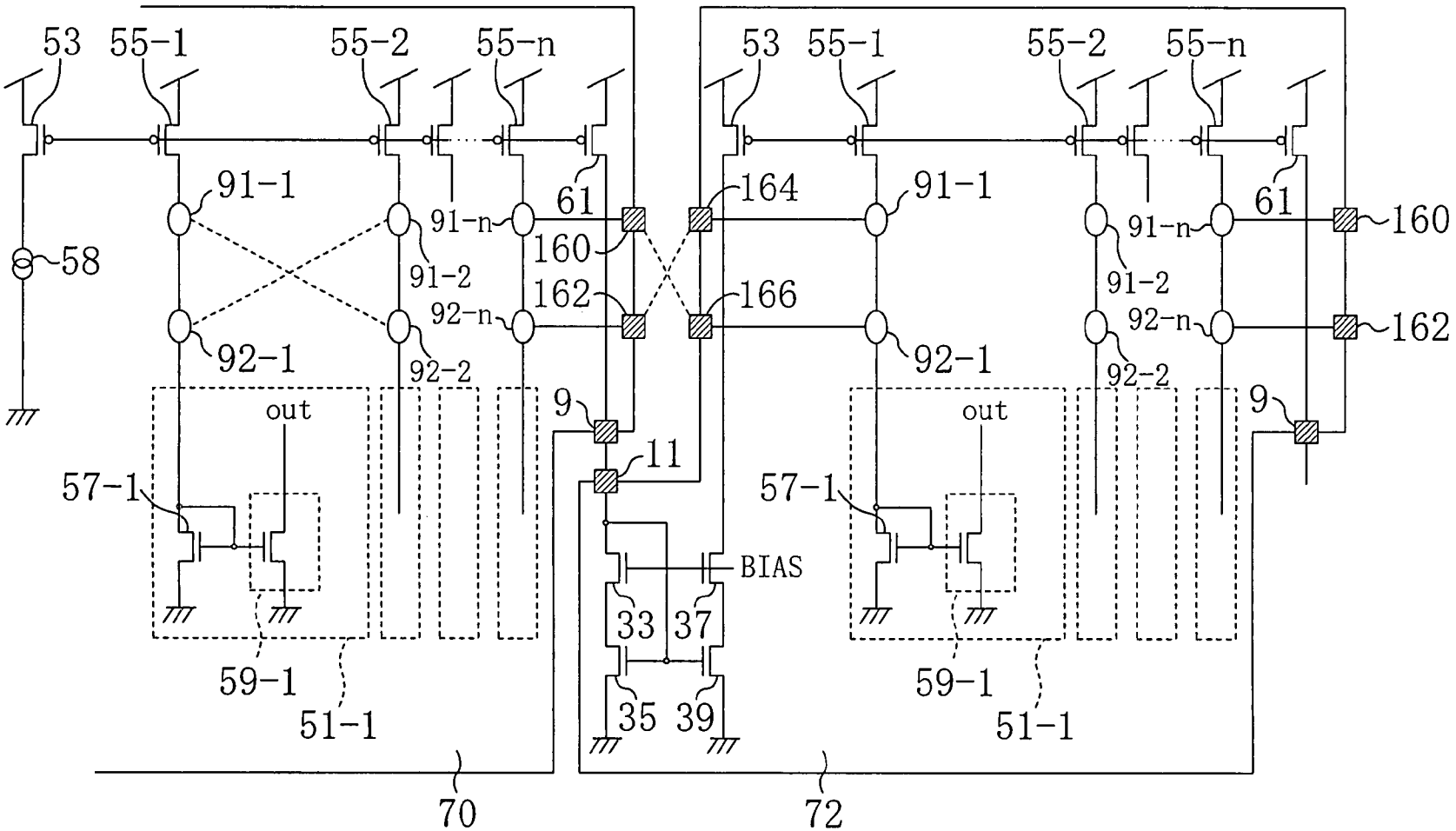
FIG. 12 is a circuit diagram illustrating a current driving device and a semiconductor chip according to a modified example of the fourth embodiment of the present invention.

FIG. 12 is a circuit diagram illustrating a current driving device and a semiconductor chip according to a modified example of the fourth embodiment of the present invention.

The current driving device of this modified example has substantially the same configuration as that of the current driving device of FIG. 9. However, this modified example is different from the fourth embodiment in that a first terminal 160 connected to a first bias current changing switch 91-*n* and a second terminal 162 connected to a second bias current changing switch 92-*n* are provided in the first semiconductor chip 70. Moreover, in a-second semiconductor chip 72, a third terminal 164 connected to a first bias current changing switch 91-1 and a fourth terminal 166 connected to a second bias current switch 92-1 are further provided in addition to the first and second terminals 161 and 162.

Thus, when a plurality of semiconductor chips each including the current driving device of this modified example are arranged, connection change can be performed not only between the current distribution MISFETs 55 and the current input MISFETs in a single semiconductor chip but also between the current distribution MISFETs 55 and the current input MISFETs provided on semiconductor chips adjacent to each other, respectively. Note that in the example shown in FIG. 12, the first terminal 160 is connected to the first bias current changing switch 91-*n* and the second terminal 162 is connected to the second bias current changing switch 92-*n*, but the first and second terminals 160 and 162 may be designed to be connected to first and second bias current changing switches 91 and 92 located at a more distance from the first and second terminals 160 and 162, respectively.

The current driving device of this modified example is driven in the above-described manner, so that not only variation in output currents from output terminals in a semiconductor chip but also variation in output currents between semiconductor chips can be reduced.

Fifth Embodiment

Figure 13:
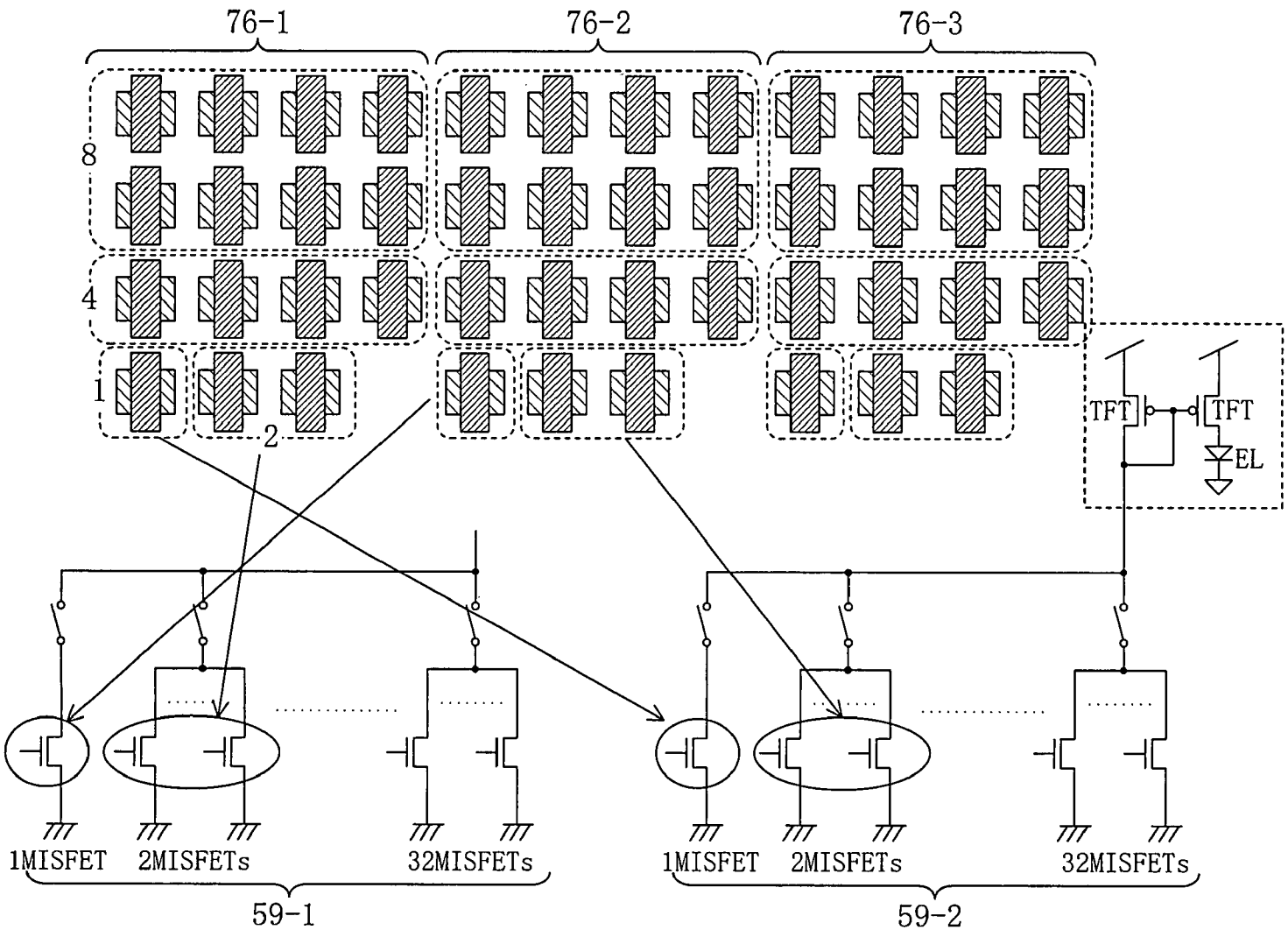
FIG. 13 is a diagram illustrating the configuration of a current supply section in a first example of a current driving device according to a fifth embodiment of the present invention.

FIG. 13 is a diagram illustrating the configuration of a current supply section in a first example of a current driving device according to a fifth the embodiment of the present invention.

In each of the current driving devices of the first through fourth embodiments of the present invention, MISFETs constituting current supply sections 59-1, 59-2 and 59-3, respectively, are arranged as shown in FIG. 13, so that ones of the MISFETs constituting each of current supply sections are located together in many cases. In the following description, in a region of a current driving device in which MISFETs are provided, part of the region in which one or more of the MISFETs constituting the current supply section 59-1 is referred to as a "first MISFET region 76-1", part of the region in which one or more of the MISFETs constituting the current supply section 59-2 is referred to as a "second MISFET region 76-2", and part of the region in which one or more of the MISFETs constituting the current supply section 59-3 is referred to as a "third MISFET region 76-3". Note that these parts are referred to as "MISFET regions 76" when the first through third MISFETs regions are not distinguished from one another. Note that although not shown in FIG. 14, 16 MISFETs and 32 MISFETs all having the same size are further provided in the MISFET region 76.

The current driving device of this example is characterized in that each of current supply sections 59 includes MISFETs provided in different MISFET regions 76 in a current driving device having the circuit arrangement described above.

As for the MISFETs constituting each of the current supply sections 59, property variation caused due to differences in locations of the MISFETs in a semiconductor chip, in fabrication process steps, and the like is found. Specifically, property variation between MISFETs located in different MISFET regions is relatively large. In the current driving device of this example, output currents are shuffled between adjacent output terminals or between output terminals located apart from each other to average property variation of the MISFETs constituting the current supply section 59. Thus variation in output currents between output terminals can be suppressed. Therefore, with the current deriving device of this example used for a display device, display nonuniformity can be suppressed, thus resulting in improved display quality.

Note that in the current driving device of this example, MISFETs in arbitrary MISFET regions 76 in a semiconductor chip may be combined to form current supply sections 59. However, as shown in FIG. 13, it is preferable to combine MISFETs in MISFET regions adjacent to each other because an interconnection becomes simple. To make output currents further uniform, however, it is necessary to combine MISFETs in MISFET regions located apart from each other. Therefore, a design is actually made taking a balance between simplicity of interconnects and the effect of reducing variation into consideration. In any case, combinations for connections between MISFETs in the MISFETs regions and output terminals of the current supply sections 59 may be determined in designing a circuit by using a random number.

Figure 14:
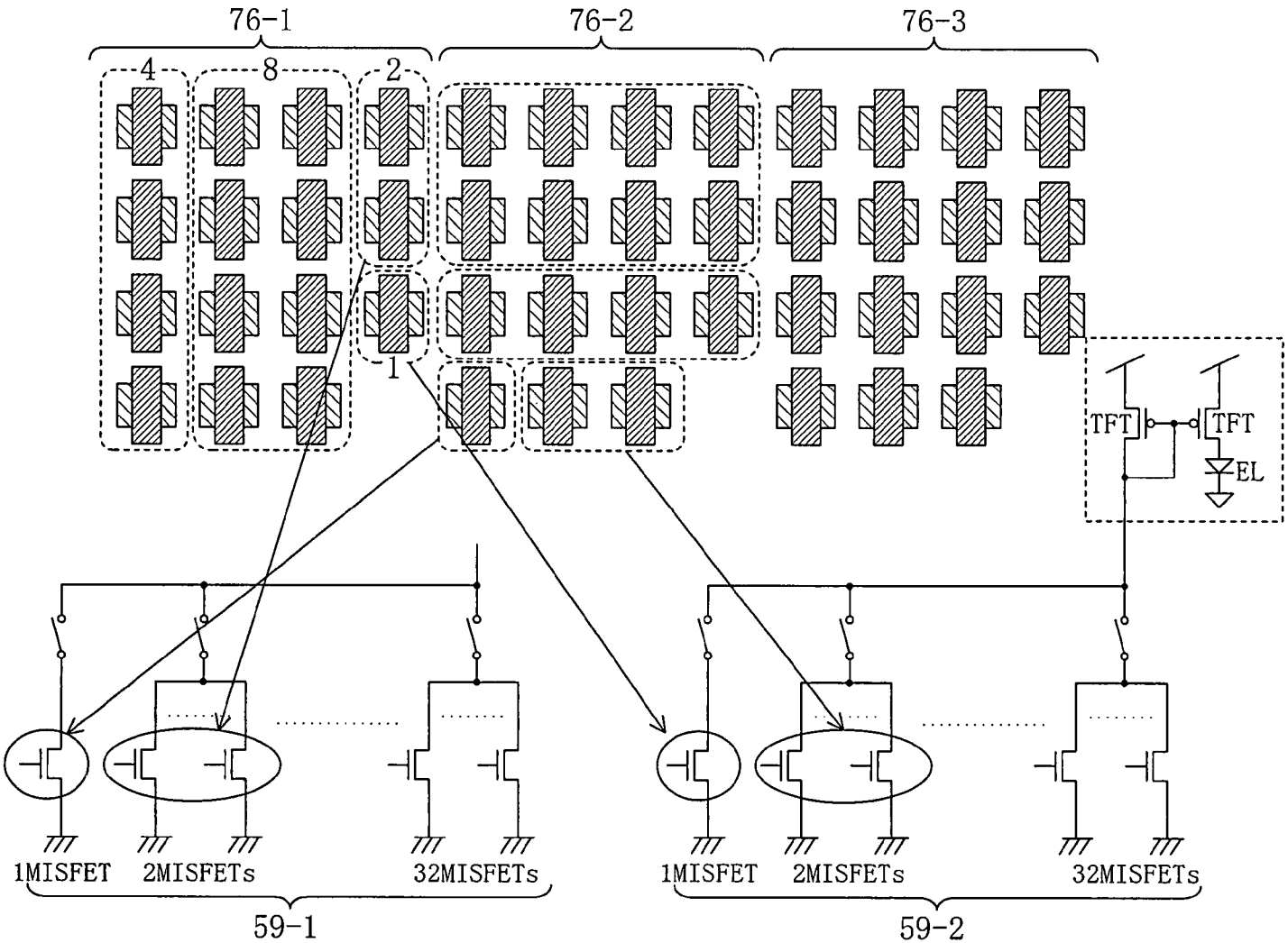
FIG. 14 is a diagram illustrating the configuration of a current supply section in a second example of the current driving device of the fifth embodiment.

Moreover, FIG. 14 is a diagram illustrating the configuration of a current supply section in a second example of the current driving device of the fifth embodiment.

In the current driving device of the first example, the arrangement of MISFETs serving as a current source according to bits in each of the MISFET regions 76 is fixed (see FIG. 13).

In contrast, in the current driving device of this example, as shown in a layout in an upper part of FIG. 14, gate electrodes of arbitrary MISFETs provided in the MISFET regions 76 are connected to one another to form each of the current supply sections 59. In other words, in the current driving device of this example, selection of MISFETs constituting a current source is changed at random in every output terminal.

Even between MISFETs provided in a single one of MISFET regions 76, property variation occurs depending on the locations of the MISFETs. Therefore, as in this example, if the current supply section 59 includes MISFETs selected at random from MISFETs provided in the MISFET regions 76, variation in output currents can be made further uniform and suppressed, compared to the first example. Thus, with the current driving device of this example used for a display device, display nonuniformity can be suppressed and display quality can be improved. Moreover, an area for switches to be provided is no longer necessary. Therefore, a circuit area can be reduced, compared to the fourth embodiment.

Figure 20:
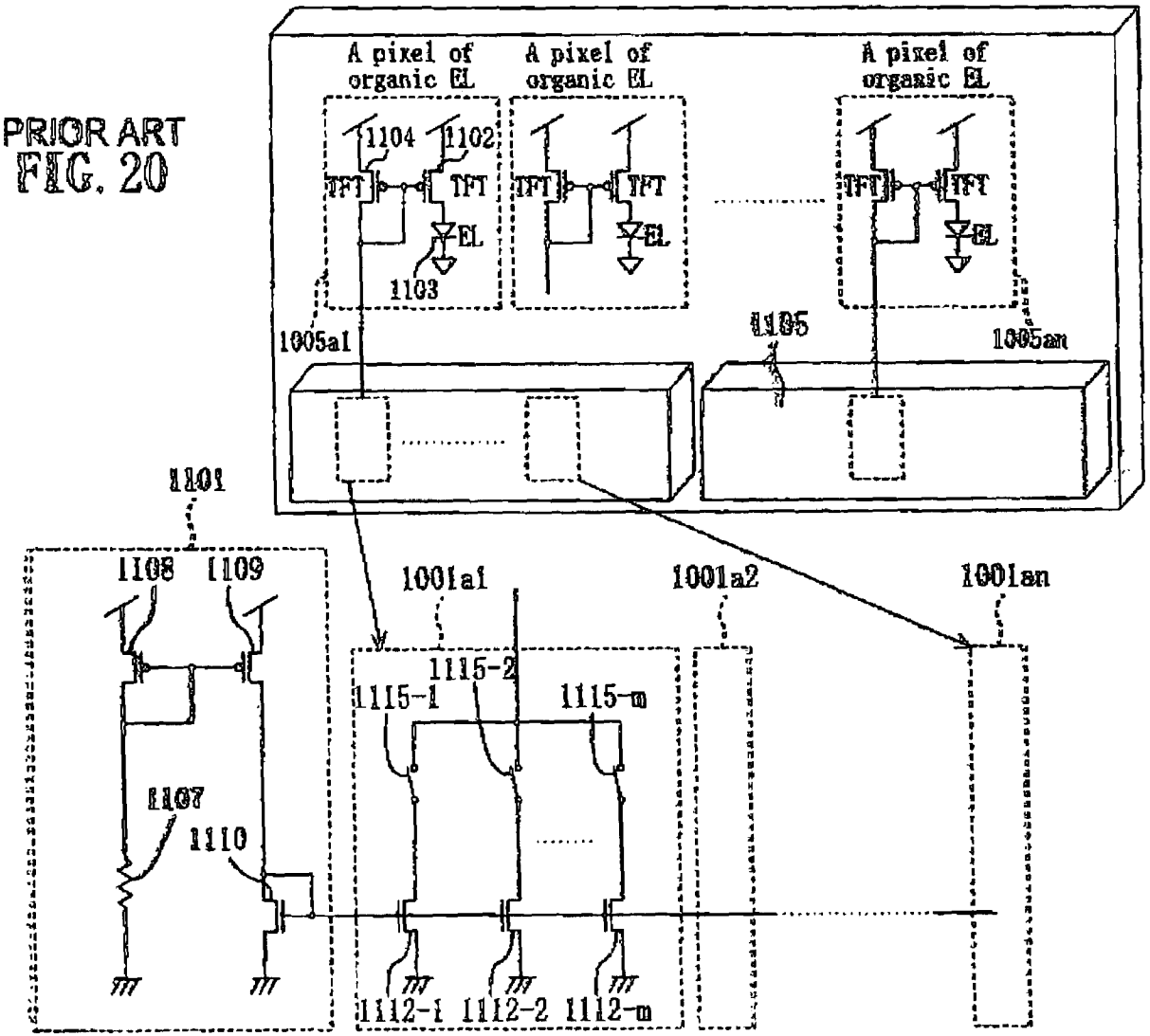
PRIOR ART FIG. 20
FIG. 20 is a circuit diagram illustrating the configurations of a display panel and a known current driving device serving as a display driver connected to the display panel.

Note that the circuit arrangement and interconnection configuration in each of the current driving devices of the first and second examples are not limited to the first through fourth embodiments, but can be applied to the known current driving device of FIG. 20 to obtain the same effects. Moreover, if the interconnection configuration is applied to the fourth embodiment, an error in currents by output terminals can be remarkably reduced.

Sixth Embodiment

Figure 15:
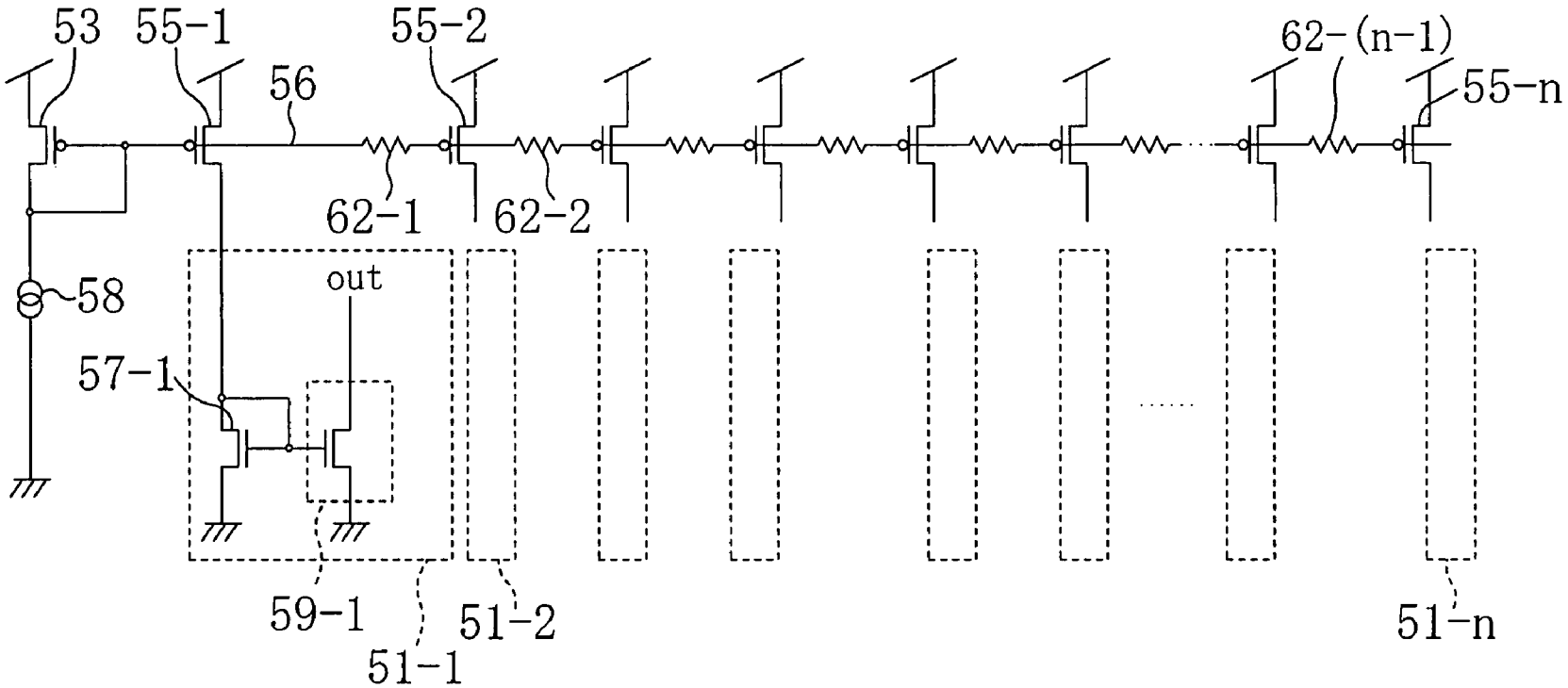
FIG. 15 is a circuit diagram illustrating a current driving device according to a sixth embodiment of the present invention.

FIG. 15 is a circuit diagram illustrating a current driving device according to a sixth embodiment of the present invention.

As shown in FIG. 15, the current driving device of this embodiment is characterized in that resistances 62 are provided on a bias line 56 and between gate electrodes of adjacent ones of current distribution MISFETs 55 in the second current driving device of FIG. 4. Herein, the "resistances 62" is an expression used when resistances 62-1, 62-2, . . . , and 62-($n$−1) are not distinguished to one another. Note that a current source or an interconnect (not shown) for causing potential gradient is connected to the reference current output terminal side of the bias line 56.

In the current driving device of this embodiment, the resistances 62 are provided, so that an error in output currents can be reduced between output terminals. This will be described hereinafter.

A current mirror circuit is provided on the assumption that diffusion conditions for transistors constituting the current mirror circuit are the same and thus there is no significant difference in threshold Vt and carrier mobility. However, if the length of a chip of the display device driver LSI is 10–20 mm, it seems difficult to uniformly diffuse an impurity contained in each of the transistors. As a result, the threshold of a transistor to serve as a current mirror varies, thus resulting in variation in output currents. Normally, the diffusion change shows gradual increase or decrease in a wafer surface. Thus, for example, the threshold Vt of the current distribution MISFETs 55 decreases along the direction from the current distribution MISFET 55-1 to the current distribution MISFET 55-$n$.

In the current driving device of this embodiment, the resistances 62 are provided on the bias line 56. Thus, a gate voltage applied to each of the current distribution MISFETs 55-1 through 55-$n$ can be varied according to the gradient of the threshold Vt. As a result, a value for a current flowing in the current distribution MISFETs 55 can be made constant.

Therefore, with the current driving device of this embodiment, variation in output currents from the current supply sections 59 in a semiconductor chip can be suppressed and thus quality of a display device can be improved.

Note that for the current driving device of this embodiment, the configuration of the reference current input and output terminals described in the first embodiment and the configurations described in the fourth and fifth embodiments may be adopted together.

Seventh Embodiment

Figure 16:
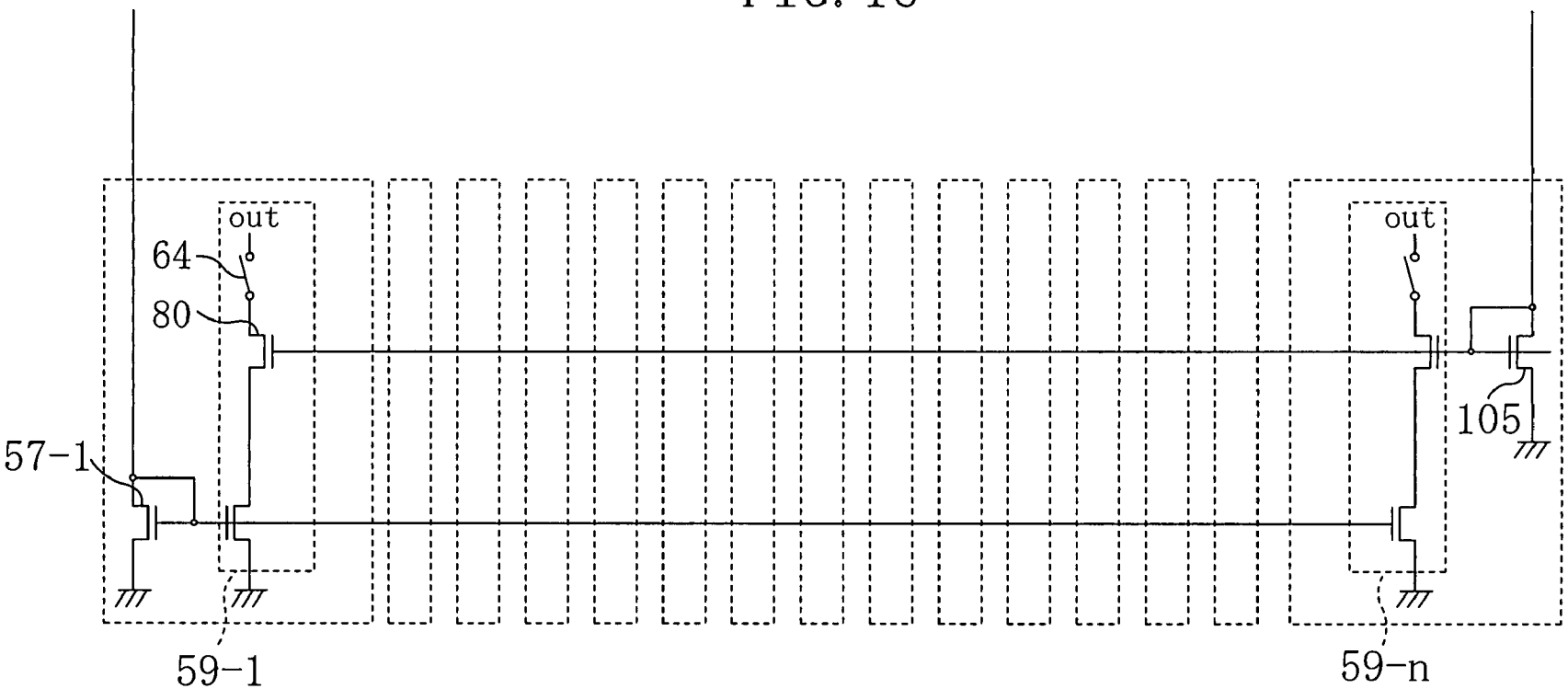
FIG. 16 is a circuit diagram illustrating a current driving device according to a seventh embodiment of the present invention.

FIG. 16 is a circuit diagram illustrating a current driving device according to a seventh embodiment of the present invention.

As shown in FIG. 16, the current driving device of this embodiment has a configuration in which in addition to the components of the known current driving device of FIG. 20, a cascode MISFET 80 having the same conductive type as that of the MISFETs and forming a cascode connection together with the MISFETs is provided in each of MISFETs constituting a current source of each of current supply sections 59. The configuration of the current supply sections 59 of FIG. 16 seems similar to that of the current supply sections 59 of FIG. 7. However, the configuration of the current supply sections 59 of FIG. 16 is different from that of the current supply sections 59 of FIG. 7 in that cascode MISFETs 80 are provided so that each of the cascode MISFETs 80 is located for one or more MISFETs constituting a current source, a switch 64 for gray scale control of an output current is provided between each of the cascode MISFETs 80 and an output terminal (not shown), and furthermore, respective gate electrodes of the cascode MISFETs 80 are connected to the gate electrode of a second current input MISFET 105 so that the gate electrodes of the cascode MISFETs 80 share the gate electrode of the second current input MISFET 105. The drain of the second current input MISFET 105 and each of the gate electrodes are connected to one another and a setting is made so that a reference current can flow therethrough. Moreover, the cascode MISFETs 80 constitute a current mirror circuit together with the second current input MISFET 0.105. For example, a second current distribution MISFET (not shown) for distributing a reference current is connected to the drain of the second current input MISFET 105.

Thus, in each section of the current supply section 59 to be described in this embodiment, a bias voltage is applied from both of the current input MISFET 57 side and the second current input MISFET 105.

With this configuration, for an output current of each of the current supply sections 59, a current to flow in MISFETs constituting a current source (i.e., current source MISFETs) when the cascode MISFETs 80 are not connected to the MISFETs and a current to flow therein when the cascode MISFETs 80 are provided alone are averaged. Although gate voltages at the same level are applied to all of the current source MISFETs and also gate voltages at the same level are applied to all of the cascode MISFETs 80, the respective thresholds of the current source MISFETs and the cascode MISFETs 80 vary depending on the respective locations of the current source MISFETs and the cascode MISFETs 80 on the semiconductor chip, so that the threshold of the current source MISFETs has a gradient in an opposite direction from that of the threshold of the cascode MISFETs 80. Accordingly, by averaging a current to flow in the current source MISFETs and a current to flow in the cascode MISFETs 80, variation in output currents in each output terminal can be averaged, so that output currents from the output terminals can be made uniform. Therefore, with the current driving device of this embodiment, a high definition display device in which display nonuniformity is suppressed can be achieved.

Note that in FIG. 16, the example in which a unit of the current input MISFET 57 and the current distribution MISFET (first MISFET) 55 and a unit of the second current input MISFET 105 and the second current distribution MISFET are provided in each semiconductor chip is shown. However, the example may be combined with another configuration shown in the description of the current driving device made in the second embodiment.

Figure 17:
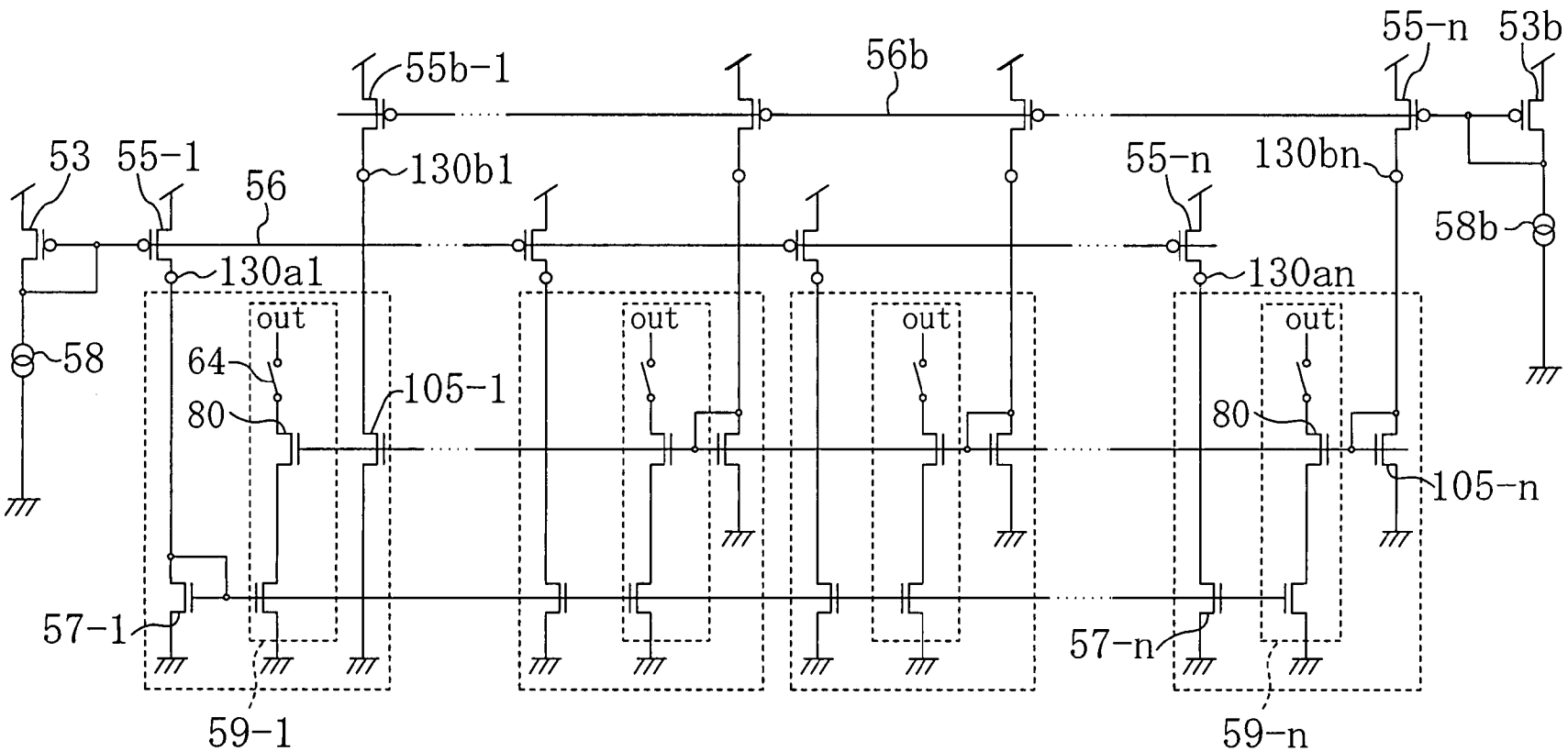
FIG. 17 is a circuit diagram illustrating a current driving device according to a first modified example of the seventh embodiment.

FIG. 17 is a circuit diagram illustrating a current driving device obtained by combining the current driving device of this embodiment with the current driving device of the second embodiment. In this current driving device, a plurality of units of the current input MISFET 57 and the current distribution MISFET 55 are provided.

In this case, it is preferable to also provide a plurality of units of the second current input MISFET 105 and the second current distribution MISFET 55*b* in each semiconductor chip. Specifically, if the number of units of the current input MISFET 57 and the current distribution MISFET 55 is the same as the number of units of the second current input MISFET 105 and the second current distribution MISFET 55*b*, variation in output currents in each-output terminal can be effectively reduced. Thus, providing these units in the same number is particularly preferable. Note that the gate electrode of the second current distribution MISFET 55*b* is connected to a shared bias line 56*b*. With this configuration, the generation of a crosstalk display can be suppressed when the current driving device of this embodiment is used for a display device.

Note that when the current driving device has this configuration, the configuration can be combined with the configurations described in the fourth and fifth embodiments. For example, the current driving device of FIG. 17 further includes connection changing means 130*a* provided between each of the current distribution MISFETs 55 and each of the current input MISFETs 57 and connection changing means 130*b* provided between each of the second current distribution MISFETs 55 and the second current input MISFET 105. The connection changing means 130*a* connects one of the current distribution MISFETs 55 to a different one of the current input MISFETs 57 in each period which has been arbitrarily set. In the same manner, the connection changing means 130*b* connects the second current distribution MISFET 55*b* to a different second current input MISFET 105 in each period which has been arbitrarily set. Thus, output currents from the current supply sections 59 can be made further uniform.

Moreover, the configuration of the current driving device of this embodiment may be combined with the configuration described in the first embodiment.

Figure 18:
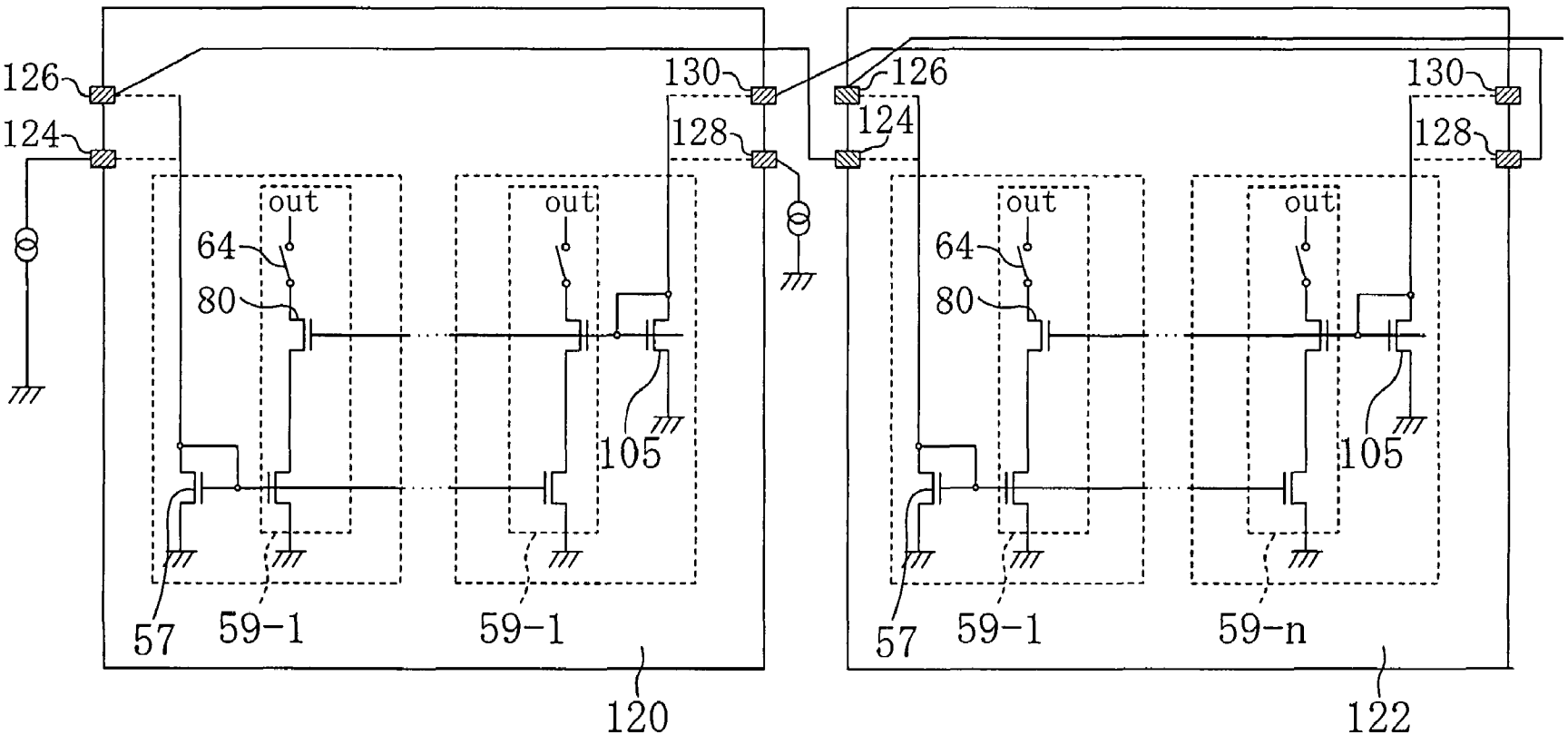
FIG. 18 is a circuit diagram illustrating a current driving device according to a second modified example of the seventh embodiment.

FIG. 18 is a circuit diagram illustrating the current driving device of this embodiment in the case where the current driving device has the terminal configuration described in the first embodiment. As shown in FIG. 18, in the current driving device of this embodiment, a first reference current input terminal 124 and a first reference current output terminal 126 can be provided in part of a semiconductor chip located at a distance of 200 μm or less, more preferably 100 μm or less, from one of the current input MISFETs 57, and a second reference current input terminal 128- and a second reference current output terminal 130 can be provided in part of the semiconductor chip located at a distance of 200 μm or less, more preferably 100 μm or less, from the second current input MISFET 105. When a plurality of semiconductor chips each including a current driving device are arranged in a frame portion of a display panel, the first reference current output terminal 126 can be connected to the first reference current input terminal 124 in a second semiconductor chip 122 in a subsequent stage and the second reference current output terminal 130 can be connected to the second reference current input terminal 128 in the second semiconductor chip. Thus, variation in output currents between semiconductor chips can be suppressed.

Eighth Embodiment

Figure 19:
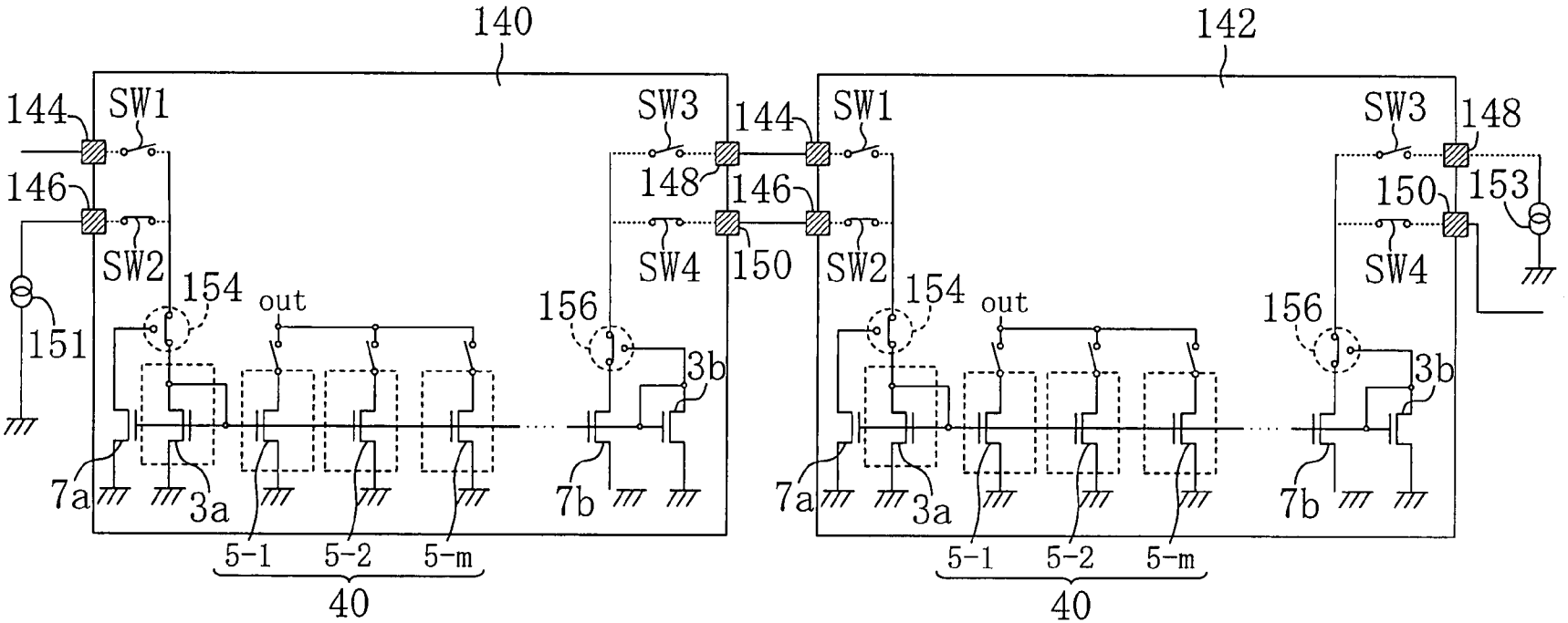
FIG. 19 is a circuit diagram illustrating semiconductor chips each including a current driving device according to an eighth embodiment of the present invention.

FIG. 19 is a circuit diagram illustrating semiconductor chips each including a current driving device according to an eighth embodiment of the present invention. In the current driving device of FIG. 19, the configuration of a current supply section 40 is the same as the current supply section 40 of FIG. 2. Therefore, the configuration of other components will be described.

The semiconductor chips of this embodiment is characterized in that when the semiconductor chips are arranged, for example, in a row in a periphery portion of a display panel, the direction in which a reference current flows is changed in every arbitrary interval of time.

As shown in FIG. 19, the current driving device of this embodiment includes a first reference current input terminal 146 connected to a reference current source 151 for making a first current flow, a first current input MISFET 3*a* which constitutes a current mirror circuit together with one or more MISFETs constituting each of current sources 5, in which a gate electrode and a drain are connected to each other and to which the first reference current is transmitted, a first current transmission MISFET 7*b* which constitutes a current mirror circuit together with the one or more MISFETs constituting each of the current sources 5 and the first current input MISFET 3*a*, a first reference current output terminal 150 to which an output current from the first current transmission MISFET 7*b* is transmitted, a second reference current input terminal 148 for receiving a second reference current output from a second reference current source 153 or a semiconductor chip in a subsequent stage, a second current input MISFET 36 which constitutes a current mirror circuit together with the one or more MISFETs constituting each of the current sources 5 and in which a gate electrode and a drain are connected to each other, a second current transmission MISFET 7*a* which constitutes a current mirror circuit together with the second current input MISFET and the one or more MISFETs constituting each of the current sources 5, a second reference current output terminal 144 to which an output current from the second current transmission MISFET 7*a* is transmitted, a switch SW1 connected to the second reference current output terminal 144, a switch SW2 connected to the first reference current input terminal 146, a switch SW3 connected to the second reference current input terminal 148, and a switch SW4 connected to the first reference current output terminal 150. Moreover, a reference current changing switch 154 is provided on a current transmission path between the first reference current input terminal 146 and the first current input MISFET 3*a* and a current transmission path between the second reference current output terminal 144 and the second current transmission MISFET 7*a* and a reference current switch 156 is provided on a current transmission path between the second reference current input terminal 148 and the second current input MISFET 3*b* and on a current transmission path between the first reference current output terminal 150 and the first current transmission MISFET 7*b*.

Moreover, the distance between the first reference current input terminal 146 and the first current input MISFET 3*a* is preferably 200 μm or less, and more preferably 100 μm or less, and the distance between the first reference current output terminal 150 and the first current transmission MISFET 7*b* is also preferably 200 μm or less, and more preferably 100 μm or less. In the same manner, the distance between the second reference current input terminal 148 and the second current input MISFET 3*b* is preferably 200 μm or less, and more preferably 100 μm or less, and the distance between the second reference current output terminal 144 and the second current input MISFET 7*a* is also preferably 200 μm or less, and more preferably 100 μm or less.

Thus, when the semiconductor chips of this embodiment are cascaded, variation in output currents in each semiconductor chip (i.e., driving currents for a pixel circuit) can be reduced.

Moreover, in a display device, when a first semiconductor chip 140 and a second semiconductor chip 142 are arranged so as to be adjacent to each other, the first reference current output terminal 150 of the first semiconductor chip 140 and the first reference current input terminal 146 of the second semiconductor chip 142 are connected to each other, and the second reference current input terminal 148 of the first semiconductor chip 140 and the second reference current output terminal 144 of the second semiconductor chip 142 are connected to each other.

In the current driving device of this embodiment, the switches SW1 and SW3 are synchronized with each other to operate and the switches SW2 and SW4 are synchronized with each other to operate. In addition, operations of the switches SW1 and SW3 are controlled so that the switches SW1 and SW3 are in an ON state when the switches SW2 and SW4 are in an OFF state and vice versa. Then, when the current driving device of this embodiment is in an operation state, as will be described next, a first period in which a first reference current is transmitted to a plurality of semiconductor chips and a second period in which a second reference current is transmitted to a plurality of semiconductor chips are alternately repeated.

First, in the first period, as shown in FIG. 19, the switches SW2 and SW4 are turned ON and the switches SW1 and SW3 are turned OFF while the reference current switch 154 makes the current transmission path between the first reference current input terminal 146 and the first current input MISFET 3*a* conductive and cuts off the current transmission path between the second reference current output terminal 144 and the second current transmission MISFET 7*a*. At the same time, the reference current switch 156 makes the current transmission path between the first reference current output terminal 150 and the first current transmission MISFET 7*b* conductive and cuts off the current transmission path between the second reference current input terminal 148 and the second current input MISFET 3*b*. By this control, a first reference current is transmitted to a plurality semiconductor chips via the first reference current input terminal 146 and the first reference current output terminal 150.

Next, in the second period, the switches SW2 and SW4 are turned OFF and the switches SW1 and SW3 are turned ON while the reference current switch 154 cuts off the current transmission path between the first reference current input terminal 146 and the first current input MISFET 3*a* and makes the current transmission path between the second reference current output terminal 144 and the second current transmission MISFET 7*a* conductive. At the same time, the reference current switch 156 cuts off the current transmission path between the first reference current output terminal 150 and the first current transmission MISFET 7*b* and makes the current transmission path between the second reference current input terminal 148 and the second current input MISFET 3*b* conductive. By this control, a second reference current supplied from the second reference current source 153 is transmitted to a plurality semiconductor chips via the second reference current input terminal 148 and the second reference current output terminal 144.

When driving a large screen display panel, it is necessary to arrange a plurality of semiconductor chips each including a current driving device. However, in the known current driving device in which a reference current is supplied from only one direction, an error tends to appear between a reference current supplied to a semiconductor chip in an initial stage and a reference current transmitted to a semiconductor chip in a final stage. Compared to the known current driving device, in the current driving device of this embodiment, reference currents from two different reference current sources are alternately transmitted in every arbitrary period, so that variation in output currents from output terminals is averaged. Therefore, with the current driving device of this embodiment, even when a display panel is large-sized, a display device in which a display is made uniform can be achieved.

Note that in FIG. 19, the configuration of the current supply section 40 is the same as that in the first embodiment. However, the current supply section 40 may have the same configuration as that of the current supply section in any one of the other embodiments as long as the configuration allows change in the direction in which a reference current flows.

Moreover, the current transmission path between the first reference current input terminal 146 and the first current input MISFET 3*a* and the current transmission path between the second reference current output terminal 144 and the second current transmission MISFET 7*a* share part of each other. However, the current transmission path between the first reference current input terminal 146 and the first current input MISFET 3*a* and the current transmission path between the second reference current output terminal 144 and the second current transmission MISFET 7*a* may be provided separately. In such a case, no reference current switch is necessary. In the same manner, the current transmission path between the first reference current output terminal 150 and the first current transmission MISFET 7*b* and the current transmission path between the second reference current input terminal 148 and the second current input MISFET 3*b* may be provided separately.

In a current driving device according to the present invention, a plurality of current distribution MISFETs for distributing a reference current and a plurality of current input MISFETs are provided on each semiconductor chip, so that output impedances at gates of MISFETs constituting a current supply section can be relatively reduced. Therefore, if the current driving device of the present invention is used for a display device, change in the gate potential of the MISFETs due to a current flowing from the display panel side can be suppressed. As a result, the generation of a crosstalk in the display device can be suppressed.

What is claimed is:

1. A current driving device comprising:

a first-conductive-type first MISFET in which a reference current flows in a driving state;

a first-conductive-type first current distribution MISFET which constitutes a current mirror circuit together with the first MISFET and makes the reference current flow;

a second-conductive-type first current input MISFET having a drain connected to the first current distribution MISFET; and a plurality of current supply sections each including second-conductive-type current source MISFETs constituting a current mirror circuit together with the first current input MISFET, switches which are connected to the current source MISFETs and turn ON or OFF a current flowing in the current source MISFETs in accordance with display data, and an output terminal which is connected to the switches and outputs a current in accordance with the display data to a display panel, the current driving device being provided on a semiconductor chip, wherein a plurality of units of the first current distribution MISFET and the first current input MISFET are provided for the semiconductor chip, and wherein a bias line connected to a gate electrode of the first MISFET and gate electrodes of the first current distribution MISFETs and shared by the gate electrodes is further provided.

2. The current driving device of claim 1, wherein all of respective gate electrodes of the current source MISFETs in the plurality of current supply sections and a gate electrode of the first current input MISFET are connected to one another.

3. The current driving device of claim 1, wherein each of the plurality of current supply sections includes a second-conductive-type first cascode MISFET which is provided between each of the switches and the output terminal and is turned ON when a voltage equal to or lower than a power supply voltage of the display panel is applied to a gate electrode in a driving state.

4. The current driving device of claim 1, wherein each of the switches is a second cascode MISFET which forms a cascode connection together with the current source MISFETs and is controlled to be turned ON or OFF depending on whether or not a predetermined voltage is applied to a gate electrode in a driving state.

5. The current driving device of claim 1, further comprising:

a first-conductive-type second MISFET which is connected to the first MISFET and in which the reference current flows in a driving state, and a first-conductive-type second current distribution MISFET provided between each of the first current distribution MISFETs and each of the first current input MISFETs and having a gate electrode connected to a gate electrode of the second MISFET.

6. The current driving device of claim 1, further comprising between each of the first current distribution MISFETs and each of the first current input MISFETs, connection changing means for changing a connection so that each of the first current distribution MISFETs is connected to a different one of the current input MISFETs in every arbitrary period.

7. The current driving device of claim 6, wherein the connection changing means includes a first bias current switch and a second bias current switch.

8. The current driving device of claim 6, further comprising:

a first-conductive-type dummy current distribution MISFET constituting a current mirror circuit together with the first MISFET and the first current distribution MISFET; and a dummy connection changing means for temporarily connecting the dummy current distribution MISFET and the current input MISFET.

9. The current driving device of claim 7, wherein on the semiconductor chip, further provided are a first terminal temporarily connected to the first bias current changing switch in a driving state and a second terminal temporarily connected to the second bias current changing switch in a driving state.

10. The current driving device of claim 1, wherein on the semiconductor chip, a plurality of MISFET regions each collectively including the current source MISFETs are arranged in a row, and wherein each of the plurality of current supply sections includes MISFETs arranged in at least two of the MISFET regions.

11. The current driving device of claim 1, further comprising a resistance element provided on the bias line and between respective gate electrodes of adjacent ones of the current distribution MISFETs.

12. The current driving device of claim 1, further comprising:

a plurality of first-conductive-type third current distribution MISFETs for transmitting the reference current in a driving state;

a plurality of second-conductive-type second current input MISFETs each having a gate electrode connected to an associated one of respective gate electrodes of the plurality of third current distribution MISFETs and a drain connected to an associated one of respective drains of the plurality of third current distribution MISFETs; and a second-conductive-type third cascode MISFET which constitutes a current mirror circuit together with the second current input MISFETs and is provided between the current source MISFETs and one of the switches.

* * * * *

UNITED STATES PATENT AND TRADEMARK OFFICE

CERTIFICATE OF CORRECTION

PATENT NO. : 7,477,094 B2
APPLICATION NO. : 10/797245
DATED : January 13, 2009
INVENTOR(S) : Yoshito Date et al.

It is certified that error appears in the above-identified patent and that said Letters Patent is hereby corrected as shown below:

ON THE TITLE PAGE:

In Item "(56) Referenced Cited", under "FOREIGN PATENT DOCUMENTS",

Change "JP 01-212026" to --JP 01-212028--;

Change "JP 03-118166" to --JP 03-118168--;

Change "JP 06-169139" to --JP 08-169139--;

Change "JP 2000-122606" to --JP 2000-126608--;

Change "JP 2001-042627" to --JP 2001-042827--;

Change "JP 2002-055854" to --JP 2002-055654--;

Change "JP 2003-0191261" to --JP 2003-091261--; and

Change "JP 2004-294762" to --JP 2004-294752--.

Signed and Sealed this

Twelfth Day of May, 2009

John Doll

JOHN DOLL
*Acting Director of the United States Patent and Trademark Office*